US009005859B2

(12) United States Patent
Sabu et al.

(10) Patent No.: US 9,005,859 B2
(45) Date of Patent: Apr. 14, 2015

(54) COLORLESS TRANSPARENT TONER, TONER SET, DEVELOPMENT AGENT, IMAGE FORMING APPARATUS, AND PRINTED MATTER

(71) Applicants: Akiyoshi Sabu, Shizuoka (JP); Shinya Nakayama, Shizuoka (JP); Atsushi Yamamoto, Shizuoka (JP); Yukiko Nakajima, Kanagawa (JP); Hideyuki Santo, Kanagawa (JP)

(72) Inventors: Akiyoshi Sabu, Shizuoka (JP); Shinya Nakayama, Shizuoka (JP); Atsushi Yamamoto, Shizuoka (JP); Yukiko Nakajima, Kanagawa (JP); Hideyuki Santo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/758,421

(22) Filed: Feb. 4, 2013

(65) Prior Publication Data

US 2013/0244011 A1 Sep. 19, 2013

(30) Foreign Application Priority Data

Mar. 15, 2012 (JP) ..... 2012-058776
Dec. 3, 2012 (JP) ..... 2012-264780

(51) Int. Cl.

| | |
|---|---|
| ***G03G 9/00*** | (2006.01) |
| ***G03G 9/087*** | (2006.01) |
| ***G03G 15/08*** | (2006.01) |
| ***G03G 9/08*** | (2006.01) |

(52) U.S. Cl.

CPC ..... *G03G 9/08764* (2013.01); *G03G 15/08* (2013.01); *G03G 9/0821* (2013.01); *G03G 9/08755* (2013.01); *G03G 9/08793* (2013.01); *G03G 9/08795* (2013.01); *G03G 9/08797* (2013.01)

(58) Field of Classification Search

CPC ..... G03G 9/08755; G03G 9/08764; G03G 9/08768; G03G 9/09708; G03G 9/09357
USPC ..... 430/109.1, 109.4, 109.5
See application file for complete search history.

(56) References Cited

U.S. PATENT DOCUMENTS

| | | | | |
|---|---|---|---|---|
| 2004/0191656 | A1* | 9/2004 | Ishiyama et al. | 430/106.1 |
| 2004/0229150 | A1* | 11/2004 | Miyazaki et al. | 430/111.4 |
| 2010/0227265 | A1* | 9/2010 | Matsumoto et al. | 430/105 |
| 2012/0282000 | A1 | 11/2012 | Nakayama et al. | |
| 2013/0143155 | A1* | 6/2013 | Santo et al. | 430/109.4 |

FOREIGN PATENT DOCUMENTS

| | | |
|---|---|---|
| JP | 62-070859 | 4/1987 |
| JP | 62-070860 | 4/1987 |
| JP | 63-038955 | 2/1988 |
| JP | 4-278967 | 10/1992 |
| JP | 9-200551 | 7/1997 |
| JP | 2001-305796 | 11/2001 |
| JP | 2012-042939 | 3/2012 |

* cited by examiner

*Primary Examiner* — Thorl Chea
(74) *Attorney, Agent, or Firm* — Oblon, McClelland, Maier & Neustadt, L.L.P.

(57) ABSTRACT

A colorless transparent toner containing a crystalline resin having a urethane bond and/or a urea bond.

12 Claims, 1 Drawing Sheet

EXAMPLE OF DIFFRACTION SPECTRUM OF X-RAY DIFFRACTION MEASURING OF TONER

EXAMPLE OF DIFFRACTION SPECTRUM OF X-RAY DIFFRACTION MEASURING OF TONER

COLORLESS TRANSPARENT TONER, TONER SET, DEVELOPMENT AGENT, IMAGE FORMING APPARATUS, AND PRINTED MATTER

CROSS-REFERENCE TO RELATED APPLICATIONS

This patent application is based on and claims priority pursuant to 35 U.S.C. §119 to Japanese Patent Application Nos. 2012-058776 and 2012-264780, filed on Mar. 15, 2012 and Dec. 3, 2012, respectively, in the Japan Patent Office, the entire disclosures of which are hereby incorporated by reference herein.

BACKGROUND

1. Field

The present invention relates to a colorless transparent toner, a toner set, a development agent, an image forming apparatus, and printed matter.

2. Background Art

There remains strong demand for improvement in the quality of images produced by image forming apparatuses, and in particular for toner capable of producing images with a uniform gloss.

To reduce uneven gloss on a recording medium on which an image is printed, for example, JP-H04-278967-A and JP-H09-200551-A describe applying colorless transparent toner over the entire recording medium or to only a portion of the recording medium without color toner, to reduce the unevenness in gloss between the chromatic color portion and the non-chromatic color portion.

In addition, there is increasing demand for image forming apparatuses capable of producing images at a high speed while using less energy for fixing the image onto the recording medium.

This leads to demand for toner with a low melting temperature.

JP-H04-24702-B (JP-S62-070589-A) and JP-H04-024703-B (JP-562-070860-A) describe methods of providing toner with low-temperature fixing properties by using a crystalline binder resin.

However, the toner described therein must strike a balance between offset resistance and abrasion resistance.

In particular, when the toner using a crystalline resin is fixed onto a substrate like paper, the attachment of the toner to the paper weakens as crystallization progresses, so that in some cases the toner layer peels off after image formation.

SUMMARY

In view of the foregoing, the present invention provides colorless transparent toner having a crystalline resin having a urethane bond and/or a urea bond.

As another aspect of the present invention, a toner set is provided which includes the colorless transparent toner mentioned above and color toner.

As another aspect of the present invention, a development agent is provided which includes the colorless transparent toner mentioned above and a carrier.

As another aspect of the present invention, an image forming apparatus which includes a latent electrostatic image bearing member to bear a latent electrostatic image thereon, a charger to charge the surface of the latent electrostatic image bearing member, an irradiator to irradiate the surface of the latent electrostatic image bearing member to form a latent electrostatic image, and a development device to develop the latent electrostatic image with the colorless transparent toner mentioned above.

As another aspect of the present invention, printed matter is provided which includes a recording medium on which a color image is formed, wherein at least part of the color image is covered with the colorless transparent toner mentioned above.

BRIEF DESCRIPTION OF THE DRAWINGS

Various other objects, features and attendant advantages of the present invention will be more fully appreciated as the same becomes better understood from the detailed description when considered in connection with the accompanying drawings, in which like reference characters designate like corresponding parts throughout and wherein.

DETAILED DESCRIPTION

Figure 1A:
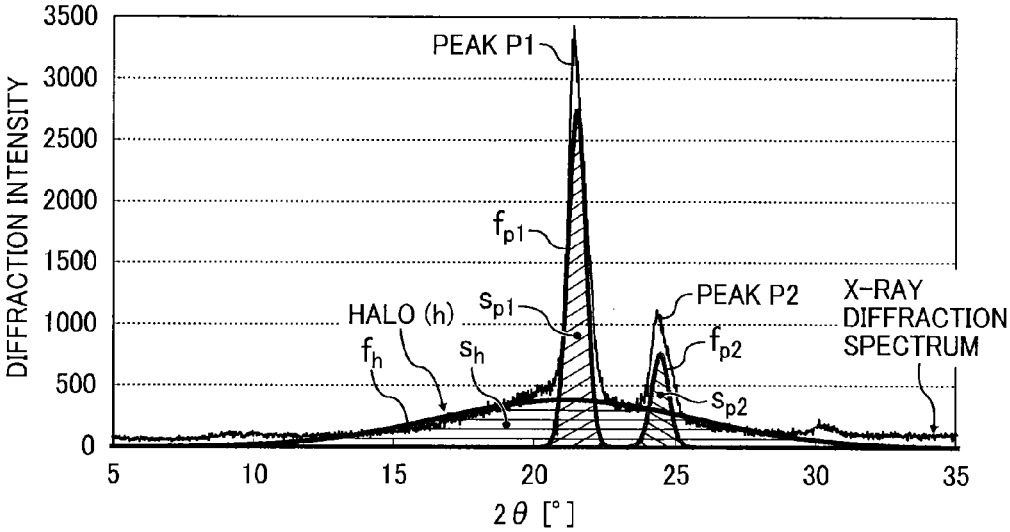
FIGS. 1A and 1B are graphs illustrating an example of a diffraction spectrum of toner of an example of the present disclosure as measured by X-ray diffraction.

The present invention is described in detail with reference to the accompanying drawings.

Binder Resin

The colorless transparent toner of the present disclosure contains a binder resin containing a crystalline resin having a urethane bond and/or a urea-bond.

The crystalline resin preferably accounts for 50% by weight or more, more preferably 65% by weight or more, furthermore preferably 80% by weight or more, and particularly furthermore preferably 95% by weight or more of the total amount of the binder resin.

When the content of the crystalline resin is too small, for example, less than 50% by weight of the total amount of the binder resin, the thermal steepness of the binder resin does not easily exhibit on the viscoelasticity of the colorless transparent toner, which may cause a trade-off problem about the low temperature fixability and high temperature stability.

Normally, the toner containing a crystalline resin is excellent about the low temperature fixability but the crystalline resin tends to be disproportionally present on the coloring agent as the crystallization progresses.

However, the colorless transparent toner of the present disclosure is free from the problem ascribable to containing a coloring agent.

In addition, the colorless transparent toner of the present disclosure contains a crystalline resin having a urethane bond and/or a urea-bond, which secures a sufficient attachment force thereof to the substrate.

The binder resin of the present disclosure may contain a non-crystalline resin in combination if the binder resin contains a crystalline resin having a urethane bond and/or a urea-bond.

The crystalline resin of the present disclosure has a ratio of the softening point to the maximum peak temperature of melting heat of from 0.8 to 1.55.

The softening point is measured by a flow tester and the maximum peak temperature is measured by a differential scanning calorimeter (DSC).

The resin having a ratio of the softening point to the maximum peak temperature of melting heat of from 0.8 to 1.55 has a characteristic of drastic softening by heat.

The softening temperature of the resin and the colorless transparent toner can be measured by a flow tester (e.g., CFT-500D, manufactured by SHIMADZU CORPORATION).

A specific example of measuring the softening temperature is: Impart a load of 1.96 MPa to one gram of a sample resin by a plunger while heating the sample resin at a temperature rising speed of 6° C./min. to extrude it from a nozzle having a diameter of 1 mm and a length of 1 mm; Plot the plunger descending amount of the flow tester against the temperature; and determine the temperature at which a half of the sample has flown out as the softening temperature.

Crystalline Resin

The crystalline resin for use in the present disclosure is described in detail next.

There is no specific limit to the crystalline resin having a urethane bond and/or a urea bond for use in the present disclosure.

Specific examples of the crystalline resins having a urethane bond and/or a urea bond include, but are not limited to, crystalline polyester resins, crystalline polyurethane resins, crystalline polyurea resins, crystalline polyamide resins, crystalline polyether resins, crystalline vinyl resins.

These can be used alone or in combination.

Among these crystalline resins having a urethane bond and/or a urea bond, it is preferable to use polyester resins, polyurethane resins, polyurea resins, polyamide resins, and polyether resins and more preferable to use straight-chain polyester resins having a urethane bond and/or a urea bond or complex resins containing the straight-chain polyester resins having a urethane bond and/or a urea bond.

It is possible to obtain a polyester resin having a urethane bond (urethane-modified polyester resins) by reacting a polyester resin having an isocyanate group at its end with a polyol.

It is possible to obtain a polyester resin having a urea bond (urea-modified polyester resins) by reacting a polyester resin having an isocyanate group at its end with an amine compound.

The maximum peak temperature of the melting heat of the crystalline resin described above is preferably from 45° C. to 70° C., more preferably from 53° C. to 65° C., and particularly preferably from 58° C. to 62° C.

When the maximum peak temperature of the melting heat of the crystalline resin is too low, the high temperature preservation stability of the resultant colorless transparent toner may deteriorate.

When the maximum peak temperature of the melting heat of the crystalline resin is too high, the low temperature fixability thereof may deteriorate.

Setting the maximum peak temperature of the melting heat of the crystalline resin to be from 45° C. to 70° C. is preferable to obtain a colorless transparent toner having a good combination of the low temperature fixability and the high temperature stability.

The ratio of the softening point to the maximum peak temperature of melting heat of the crystalline resin preferably ranges from 0.8 to 1.55, more preferably from 0.85 to 1.25, furthermore preferably from 0.9 to 1.2, and particularly furthermore preferably from 0.9 to 1.19 in terms of the trade-off between the low temperature fixing property and the high temperature stability of the obtained colorless transparent toner.

With regard to the viscoelasticity of the crystalline resin, the storage elastic modulus G' of the crystalline resin at a temperature (maximum peak temperature of the melting heat+20° C.) is preferably from $5.0\times10^6$ Pa·s or less, more preferably from $1.0\times10^1$ Pa·s to $5.0\times10^5$ Pa·s, and furthermore preferably from $1.0\times10^1$ Pa·s to $1.0\times10^4$ Pa·s.

The loss elastic modulus G" of the crystalline resin at a temperature (maximum peak temperature of the melting heat+20° C.) is preferably $5.0\times10^6$ Pa·s or less, more preferably from $1.0\times10^1$ Pa·s to $5.0\times10^5$ Pa·s, and furthermore preferably from $1.0\times10^1$ Pa·s to $1.0\times10^4$ Pa·s.

In the present disclosure, it is preferable to use a colorless transparent toner having G' and G" ranging from $1.0\times10^1$ Pa·s to $5.0\times10^5$ Pa·s at a temperature (maximum peak temperature of the melting heat+20° C.) in terms of a good combination between the fixing strength and the hot offset resistance.

Moreover, if the other materials described later are dispersed in the binder resin, G' nad G' tend to increase.

Therefore, the viscoelasticity of the crystalline resin is preferable in the range mentioned above.

The viscoelasticity of the crystalline resin can be adjusted by, for example, adjusting the ratio between the crystalline monomer and the non-crystalline monomer constituting the resin and the molecular weight thereof.

For example, G' decreases as the ratio of the crystalline monomer increases.

The dynamic viscoelasticity such as storage elastic modulus G' and the loss elastic modulus G" can be measured by a dynamic viscoelasticity measuring device (for example, ARES, manufactured by TA INSTRUMENT JAPAN INC.).

The following is a brief description about an example of the measuring methods.

The measuring is conducted at a frequency of 1 Hz.

Mold a measuring sample to a pellet having a diameter of 8 mm and a thickness of from 1 mm to 2 mm; Fix the pellet on a parallel plate having a diameter of 8 mm; Stabilize it at 40° C.; and heat it at a frequency of 1 Hz (6.28 rad/s) with a distortion amount of 0.1% (distortion amount control mode) to 200° C. at a temperature rising speed of 2.0° C./min. to measure the dynamic viscoelasticity.

The colorless transparent toner of the present disclosure preferably has a ratio {C/(C+A)} of 0.15 or greater and more preferably 0.17 or greater, where C represents the integration intensity of the spectrum deriving from the crystalline structure and A represents the integration intensity of the spectrum deriving from the non-crystalline structure in the diffraction spectrum obtained by an X-ray diffraction device.

The obtained toner has a good combination of the fixability and the high temperature preservation stability by satisfying the ratio {C/(C+A)} to be 0.15 or greater.

When the colorless transparent toner of the present disclosure contains a releasing agent (wax), a diffraction peak tends to appear at a position of $2\theta=23.5°$ to 24° in the diffraction spectrum.

However, when the content of the wax based on the total weight of the toner is less than, for example, 15% by weight, the contribution of the diffraction peak ascribable to the wax is ignorable and can be left out of consideration.

When the content of the wax is excessively large, a value obtained by subtracting the integral intensity of the spectrum deriving from the crystalline structure of the wax from the integral intensity of the spectrum deriving from the crystalline structure is determined as the integration intensity C deriving from the crystalline structure.

In the present disclosure, the ratio {C/(C+A)} is an index that indicates the amount of the crystallized portion in the toner, which is mainly the amount of the crystallized portion of the binder resin contained in the toner as the main component.

In the present disclosure, X-ray diffraction measuring is conducted by using a known X-ray diffraction device.

A specific example is a two-dimension detector installed X-ray diffraction device (D8 DISCOVER with GADDS, manufactured by BRUKER JAPAN CO., LTD.).

This ratio of known toner that contains a crystalline resin and wax in an amount significantly the same as that of an additive is normally less than 1.5.

The capillary used for measuring is a mark tube (Lindemann glass) having a diameter of 0.70 mm in the X-ray diffraction measuring in the present disclosure.

A sample is stuffed to the upper portion of the capillary tube for measuring.

The sample is tapped 100 times when stuffing the sample.

The detailed conditions of the X-ray diffraction measuring are as follows:

Current: 40 mA
Voltage: 40 kV
Goniometer 2θ axis: 20.0000°
Goniometer Ω axis: 0.0000
Goniometer ϕ axis: 0.0000°
Goniometer ϕ axis: 0.0000°
Detector distance: 15 cm (wide angle measuring)
Measuring range: 3.2≤2θ (°)≤37.2
Measuring time: 600 sec.

A collimator having a 1 mm ϕ pinhole is used as the light incident optical system. The obtained two-dimensional data are integrated (X axis: 3.2° to 37.2)° and converted by an installed software to single-dimensional data of the diffraction intensity and 2θ.

Based on the obtained X-ray diffraction measuring results, the method of calculating the ratio {C/(C+A)} is described below.

Figure 1B:
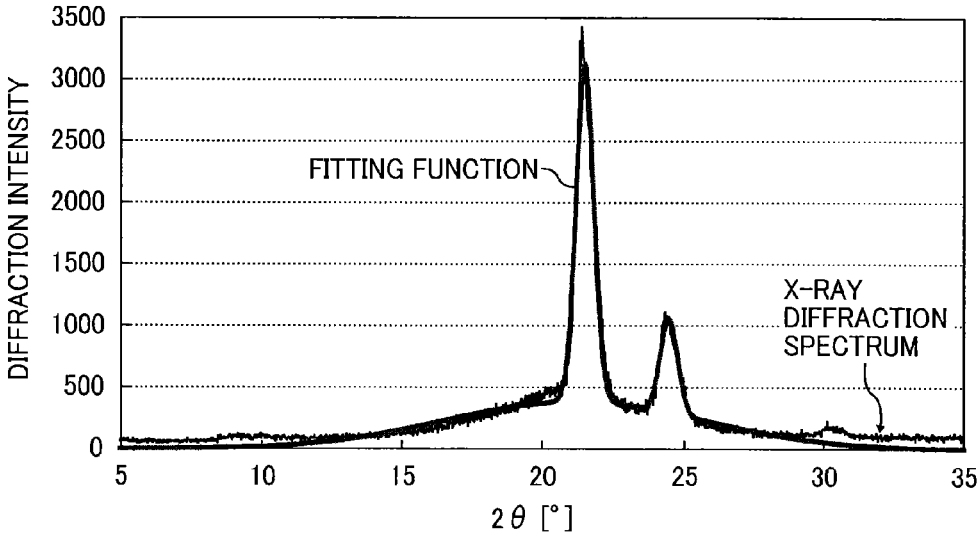

FIGS. 1A and 1B are graphs illustrating an example of the diffraction spectrum of X-ray diffraction measuring for the toner of the present disclosure.

In FIGS. 1A and 1B, the X axis represents 2θ and the Y-axis represents the X-ray diffraction intensity.

Both X-axis and Y-axis are linear axes.

As illustrated in FIG. 1A, in the X-ray diffraction pattern of the crystalline resin of the present disclosure, the main peaks of P1 and P2 are at 2θ of 21.3° and 24.2°.

Halo (h) is observed in a wide range including these two peaks.

The main peaks are ascribable to the crystalline portions and, the halo, the non-crystalline portion.

Gaussian function of these two main peaks and halo are as follows:

$$f_{p1}(2\theta)=a_{p1}\exp\{-(2\theta-b_{p1})^2/(2c_{p1}^2)\} \quad \text{\{Relation A (1)\}}$$

$$f_{p2}(2\theta)=a_{p2}\exp(-(2\theta-b_{p2})^2/(2c_{p2}^2)\} \quad \text{\{Relation A (2)\}}$$

$$f_h(2\theta)=a_h\exp\{-(2\theta-b_h)^2/(2c_h^2)\} \quad \text{\{Relation A (3)\}}$$

$f_{p1}(2\theta)$, $f_{p2}(2\theta)$, and $f_h(2\theta)$ are functions corresponding to the main peaks P1 and P2 and halo, respectively.

The sum of these three functions:

$f(2\theta)=f_{p1}(2\theta)+f_{p2}(2\theta)+f_h(2\theta)$ {Relation A (4)} is defined as the fitting function of the entire X-ray diffraction spectrum as illustrated in FIG. 1B and fitting is conducted by the least-square approach.

The fitting functions in fitting are nine functions of $a_{p1}$, $b_{p1}$, $c_{p1}$, $a_{p2}$, $b_{p2}$, $C_{p2}$, $a_h$, $b_h$, and $c_h$.

As the initial values for fitting of each variable, the peak positions of the X-ray diffraction are assigned for $b_{p1}$, $b_{p2}$, and $b_h$ ($21.3=b_{p1}$, $24.2=b_{p2}$, $22.5=b_h$ in the example illustrated in FIGS. 1A and 1B) and suitable values are assigned for the other variables to make the two main peaks and the halo significantly match the X-ray diffraction spectrum.

Fitting may be conducted by, for example, SOLVER features of EXCEL 2003 manufactured by MICROSOFT CORPORATION.

The ratio {C/(C+A)}, the index indicating the amount of the crystallized portion, can be calculated by the integral areas ($S_{p1}$, $S_{p2}$, and $S_h$), where C represents $S_{p1}+S_{p2}$ and A represent $S_h$ calculated by Gaussian integration of Gaussian functions ($f_{p1}(2\theta)$, $f_{p2}(2\theta)$) corresponding to the two main peaks P1 and P2 and Gaussian function ($f_h(2\theta)$) corresponding to the halo after fitting.

In addition, the toner of the present disclosure preferably satisfies the following condition 1 with regard to the maximum endothermic peak temperature T1 (° C.) and the maximum exothermic peak temperature T1 (° C.) as measured by the following method: By satisfying the following condition 1, it is possible to reduce the damage caused during image transfer.

$$T1-T2\leq 30^\circ\text{ C. and }T2\geq 30^\circ\text{ C.} \quad \text{Condition 1}$$

Measuring Method and Measuring Condition of Maximum Endothermic Peak and Maximum Exothermic Peak of Toner The maximum endothermic peak of the toner is measurable by DSC SYS1EM Q-200 (manufactured by TA INSTRUMENTS. JAPAN).

To be specific, place about 5.0 g of toner to be measured in a aluminum sample container; place the container on a holder unit to set it in an electric furnace; then, raise the temperature to 100° C. in a nitrogen atmosphere from 0° C. at a temperature rising speed of 10° C./min.; cool down from 100° C. to 0° C. at a temperature descending speed of 10° C./min; raise the temperature from 0° C. to 100° C. at a temperature rising speed of 10° C./min; choose the DSC curve at the second temperature rising using the analysis program in the DSC SYSTEM Q-200 to measure the maximum endothermic peak temperature T1 of the toner.

In addition, measure the maximum exothermic peak temperature T2 of the toner at the temperature descending described above (for the first time) in the same manner.

In the present disclosure, T1 of the toner preferably ranges from 50° C. to 70° C. and more preferably from 53° C. to 65° C. and furthermore preferably from 58° C. to 62° C.

When T1 is within the range of from 50° C. to 70° C., the high temperature preservation stability of the toner can be secured and a toner having an excellent low temperature fixability can be obtained.

When T1 is too low, the high temperature preservation stability tends to deteriorate and when T1 is too high, the low temperature fixability may deteriorate.

In the present disclosure, T2 of the toner preferably ranges from 30° C. to 55° C. and more preferably from 35° C. to 55° C. and furthermore preferably from 40° C. to 55° C.

When T2 is too low, the fixed image tends to be cooled down and solidified slowly, which may lead to blocking of the toner image or scars during transfer of the printed matter in the paper path. It is preferable T2 is as high as possible.

However, T2 is the crystallization temperature and never surpasses T1, which is the melting point.

That is, while maintaining excellent high temperature preservation stability and the low temperature fixability, it is preferable that the temperature difference (T1−T2) is within a narrow range to some extent to reduce the blocking or scars during transfer of the image in the paper path in the image forming apparatus.

To be specific, the difference (T1−T2) is preferably 30° C. or less, more preferably 25° C. or less, and particularly preferably 20° C. or less.

When the difference (T1−T2) is too large, for example, 40° C. or greater, the temperature difference between the fixing temperature and the solidification temperature of the toner image tends to become wide, so that it is not possible to reduce the blocking or scars during transfer of the image.

The toner of the present disclosure preferably contains a component having a molecular weight of 100,000 or more in an amount of 5% or more, more preferably 7% or more, and furthermore preferably 9% or more as the tetrahydrofuran (THF) soluble portion of the toner as measured by a gel permeation chromatography (GPC). The fluidity and the viscoelasticity of the toner after the toner is melted is less dependent on the temperature when the toner contains a component having a molecular weight of 100,000 or more in an amount of 5% or more.

Consequently, the fluidity and the viscoelasticity of the toner do not significantly change irrespective of the kind of paper, for example, from thin paper easy to convey heat to thick paper difficult to convey heat.

Meaning that the toner is fixed at a constant temperature and speed.

When the amount of the component having a molecular weight of 100,000 or more contained in the toner is too small, the fluidity and the viscoelasticity of the toner after the toner is melted significantly change depending on the temperature.

For example, the toner tends to deform excessively if an image is fixed on thin paper, the attachment area of the toner to the fixing member increases.

As a result, the toner is not easily released from the fixing member, thereby causing winding-round of the paper.

The weight average molecular weight of the toner of the present disclosure preferably ranges from 20,000 to 70,000.

A weight average molecular weight that is too large tends to cause the fixability to worsen, the gloss to deteriorate, and a fixed image to easily peel off upon external stress.

A weight average molecular weight that is too small tends to cause the internal agglomeration force during toner melting to be low, which leads to occurrence of hot-offset and winding of paper around the fixing member.

In addition, the weight average molecular weight of the crystalline resin preferably ranges from 2,000 to 100,000, more preferably from 5,000 to 60,000, and furthermore preferably from 8,000 to 30,000 in terms of the fixability of the colorless transparent toner.

When the weight average molecular weight is too small, the hot offset resistance of the colorless transparent toner tends to worsen.

On the other hand, when the weight average molecular weight is too large, the low temperature fixability tends to deteriorate.

In the present disclosure, the tetrahydrofuran soluble portion of the toner and the molecular weight distribution and the weight average molecular weight (Mw) of the resin can be measured by using a Gel Permeation Chromatography (GPC) measuring device. A specific example of the GPC measuring device is HLC-8220 GPC (manufactured by TOSOH CORPORATION).

The column is TSK gel Super HZM-M 15 cm triplet (manufactured by TOSOH CORPORATION). The resin to be measured is dissolved to obtain a 0.15% by weight solution of tetrahydrofuran (THF) (containing a stabilizer, manufactured by WAKO PURE CHEMICAL INDUSTRIES, LTD.) followed by filtration using a filter having an opening of 0.2 μm.

The resultant filtrate is used as a THF sample solution.

Infuse 100 μl of the THF sample solution into the measuring instrument under the condition that the temperature is 40° C. and the flow speed is 0.35 ml/min.

The molecular weight is calculated by using a standard curve made by a mono-dispersed polystyrene standard sample.

The mono-dispersed polystyrene standard samples are Showdex STANDARD SERIES (manufactured by SHOWA DENKO K.K.) and toluene.

To be specific, prepare THF solutions for the following three kinds of mono-dispersed polystyrene standard samples; measure them under the conditions described above; and obtain a standard curve by setting the maintaining time of the peak top as the light scattering molecular weight of the mono-dispersed polystyrene standard samples.

| The three kinds of mono-dispersed polystyrene standard samples are: | |
|---|---|
| Solution A: | S-7450: 2.5 mg; |
| | S-678: 2.5 mg, |
| | S-46.5: 2.5 mg, |
| | S-2.90: 2.5 mm, |
| | THF: 50 ml, |
| Solution B: | S-3730: 2.5 mg, |
| | S-257: 2.5 mg, |
| | S-19.8: 2.5 mg, |
| | S-0.580: 2.5 mm, |
| | THF: 50 ml, |
| Solution C: | S-1470: 2.5 mg, |
| | S-112: 2.5 mg, |
| | S-6.93: 2.5 mg, |
| | toluene: 2.5 mg, |
| | THF: 50 ml. |

A refractive index (RI) detector is used as the detector.

The content ratios of the component having a molecular weight of 100,000 or more and the component having a molecular weight of 250,000 or more can be obtained by the intersection of the molecular weight of 100,000 and the molecular weight of 250,000 in the integrated molecular weight distribution curve.

In the toner of the present disclosure, the ratio ($\Delta H(H)/\Delta H(T)$) of the endothermic amount ($\Delta H(H)$) of the insoluble portion of the toner in a liquid mixture of ethyl acetate and tetrahydrofuran (THF) having a mixing ratio of 1:1 as measured by DSC to the endothermic amount ($\Delta H(T)$) of the toner as measured by a differential scanning calorimeter (DSC) preferably ranges from 0.2 to 1.25, more preferably from 0.3 to 1.0, and furthermore preferably from 0.4 to 0.8.

The low temperature fixability ameliorates when the ratio ($\Delta H(H)/\Delta H(T)$) is within the range mentioned above.

A specific method of measuring the insoluble portion in the liquid mixture of tetrahydrofuran (THF) and ethyl acetate with a mixing ratio of 1:1 is: add 0.4 g of the toner to the liquid mixture at room temperature (20° C.) followed by mixing and shaking; settle down the insoluble portion by a centrifugal; remove the supernatant solution; and vacuum-dry the resultant.

The toner of the present disclosure preferably has a maximum peak temperature of the melting heat for the second time temperature rising as measured by a differential scanning calorimeter (DSC) of from 50° C. to 70° C., more preferably from 55° C. to 68° C., and furthermore preferably from 58° C. to 65° C. and the amount of heat of melting for the second time temperature rising is preferably from 30 J/g to 75 J/g, more preferably from 45 J/g to 70 J/g, and furthermore preferably from 50 J/g to 60 J/g.

It is preferable to satisfy the conditions mentioned above to provide a good combination of the low temperature fixing property and the high temperature stability at a higher level and improve the hot offset resistance.

When the maximum peak temperature of the melting heat of the toner is too low, the toner tends to block at high temperatures.

When the maximum peak temperature of the melting heat of the toner is too high, the low temperature fixing property tends to worsen.

In addition, when the amount of heat of melting of the toner is too small, the amount of the portions having crystalline structures in the toner tends to be small, so that the sharp melting property deteriorates, resulting in a bad combination of the high temperature stability and the low temperature fixing property.

On the other hand, when the amount of heat of melting of the toner is too large, the energy to melt and fix the toner tends to increase, which may degrade the fixability depending on the fixing device.

The maximum peak temperature of the melting heat of the toner can be measured by a differential scanning calorimeter (DSC) (for example, TA-60W and DSC-60, manufactured by SHIMADZU CORPORATION) as in the case of the resin.

To be specific, raise the temperature of a sample to be measured for the maximum peak temperature of the melting heat from 20° C. to 150° C. at a temperature rising speed of 10° C./min.; Cool down to 0° C. at a temperature descending speed of 10° C./min.; Raise the temperature again at a temperature rising speed of 10° C./min. to measure the endothermic change; and draw graphs of "endothermic amount" and "temperature".

The temperature corresponding to the maximum peak of the endothermic mount is determined as the maximum peak temperature of the melting heat for the second time temperature rising.

The endothermic amount of the endothermic peak having this maximum peak temperature is determined as the amount of heat of melting for the second time temperature rising.

Polyester Resin

As described above, it is possible to obtain a urethane-modified polyester resin is obtained by reacting a polyester resin having an isocyanate group at its end with a polyol.

It is possible to obtain a urea-modified polyester resin by reacting a polyester resin having an isocyanate group at its end with an amine compound.

The polyester resin of the urethane-modified polyester resin and the urea-modified polyester resin are described in detail.

As the polyester resin, it is possible to use a polycondensation compound obtained by polycondensation of a polyol and a polycarboxylic acid, a lactone ring opening polymer obtained by lactone ring opening polymerization of a lactone compound (monolactone, etc.), and a polyhydroxycarboxylic acid.

Among these, the polyester resins synthesized by polycondensation of a polyol (diol) and a polycarboxylic acid (dicarboxylic acid) are preferable in terms of demonstration of the crystallinity.

Specific examples of the polyol include, but are not limited to, diols, and tri- or higher polyols.

Specific examples of the diol include, but are not limited to, straight-chain type aliphatic diols, branch-type aliphatic diols, alkylene ether glycol having 4 to 36 carbon atoms, alicyclic diols having 4 to 36 carbon atoms, alkylene oxides (AO) of alicyclic diols, adducts of bisphenols with AO, polylactone diols, polybutadiene diols, diols having carboxylic groups, diols having sulfonic acid group or sulfamic acid group, and diols having other functional groups of these salts.

These can be used alone or in combination.

Among these diols, it is preferable to use aliphatic diols having 2 to 36 carbon atoms in the chain and more preferable to use straight chain type aliphatic diols.

When using a straight chain type aliphatic diol, the content thereof is preferably 80 mol % or more and more preferably 90 mol % or more of the entire diol.

When the content is 80 mol % or more, the crystallinity of the resin ameliorates.

In addition, the colorless transparent toner can have a good combination of the low temperature fixing property and the high temperature stability, resulting in improvement of the resin hardness.

Specific examples of the straight chain type aliphatic diols include, but are not limited to, ethylene glycol, 1,3-propane diol, 1,4-butane diol, 1,5-pentane diol, 1,6-hexane diol, 1,7heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol.

Among the straight chain type aliphatic diol specified above, in terms of availability in the market, it is preferable to use ethylene glycol, 1,3-propane diol, 1,4-butane diol, 1,6-hexane diol, 1,9-nonane diol and 1,10-decane diol.

Specific examples of the branch chain type aliphatic diols having 2 to 36 carbon atoms in the chain include, but are not limited to, 1,2-propane glycol, butane diol, hexane diol, octane diol, decane diol, dodecane diol, tetradecane diol, neopentyl glycol, and 2,2-diethyl-1,3-propane diol.

Specific examples of the alkylene ether glycol having 4 to 36 carbon atoms include, but are not limited to, diethylene glycol, triethylene glycol, dipropylene glycol, polyethylene glycol, polypropylene glycol, and polytetramethylene ether glycol.

There is no specific limit to the alicyclic diols having 4 to 36 carbon atoms.

Specific examples thereof include, but are not limited to, 1,4-cyclohexane dimethanol and hydrogenated bisphenol A.

There is no specific limit to the alkylene oxide of the alicyclic diols.

Specific examples thereof include, but are not limited to, adducts (added number of mols: 1 to 30) with such as ethylene oxide (EO), proplyene oxide (PO), buthylene oxide (BO).

There is no specific limit to the bisphenols.

Specific examples thereof include, but are not limited to, adducts of bisphenol A, bisphenol F, and bisphenol S with 2 to 30 mols of AO (EO, PO, and BO).

There is no specific limit to the polylacotone diols.

A specific example thereof is polyε-caprolactone diol.

There is no specific limit to the diols having carboxylic groups.

Specific examples thereof include, but are not limited to, dialkylol alkanic acid having 6 to 24 carbon atoms such as 2,2-dimethylo propionic acid (DMPA), 2,2-dimethylol butanoic acid, 2,2-dimethylol heptanoic acid, and 2,2-dimethylol octanoic acid.

There is no specific limit to the diols having sulfonic acid group or sulfamic acid group.

Specific examples thereof include, but are not limited to, N,N-bis(2-hydroxyalkyl) sulfonic acid diol and adducts thereof with AO, where the alkyl group has one to six carbon atoms, AO includes EO, PO, or mixtures thereof, and the mol number of AO is from one to six and N,N-bis(2-hydroxyalkyl) sulfonic acid diol and adducts thereof with AO, where the alkyl group has one to six carbon atoms, AO includes EO, PO, or mixtures thereof, and the mol number of AO is from one to six.

There is no specific limit to the neutralizing bases when using diols having neutralizing bases.

Specific examples thereof include, but are not limited to, tertiary amines (triethyl amine) having 3 to 30 carbon atoms and alkali metals (sodium salts, etc.).

Among these, it is preferable to use polyols such as an alkylene glycol having 2 to 12 carbon atoms, a diol having a carboxylic group, an adduct of a bisphenol with AO, and a combination thereof.

There is no specific limit to the tri- or higher alcohol components.

Specific examples thereof include, but are not limited to, tri- or higher aliphatic polyols having 3 to 36 carbon atoms (e.g., alkane polyools and inner or inter molecular dehydrated compounds thereof, e.g., glycerine, trimethylol ethane, trimethylol propane, pentaerythritol, sorbitol, sorbitane, and polyglycerine); Sugars and derivatives thereof (e.g., sucrose and methyl glucoside); adducts of trisphenols (e.g., triphenol PA) with 2 mols to 30 mols of AO; adducts of novolac resins (e.g., phenolic novolac and cresol novolac) with 2 mols to 30 mols of AO; and copolymers of acrylic polyol (e.g., copolymers of hydroxyethyl (meth)acrylate and another vinyl-based monomer).

Among these, tri- or higher aliphatic polyols and adducts of novolac resins with AO are preferable and adducts of novolac resins with AO are more preferable.

The polycarboxylic acid to react with the polyol is described next.

Specific examples of the polycarboxylic acid include, but are not limited to, dicarboxylic acids and tri- or higher polycarboxylic acids.

There is no specific limit to the dicarboxylic acid.

Specific examples thereof include, but are not limited to, aliphatic dicarboxylic acids such as straight chain type aliphatic dicarboxylic acids and the branch-chained type aliphatic dicarboxylic acids and aromatic dicarboxylic acids.

Among these, using the straight chain type aliphatic dicarboxylic acids is preferable.

There is no specific limit to the aliphatic dicarboxylic acids.

Specific examples thereof include, but are not limited to, alkane dicarboxylic acids having 4 to 36 carbon atoms such as succinic acid, adipic acid, sebacic acid, azelaic acid, dodecane dicarboxylic acid, octadecane dicarboxylic acid, and decyl succinic acid; alkenyl succinic acids such as dodecenyl succinic acid, pentadecenyl succinic acid, and octadecenyl succinic, alkene dicarboxylic acids having 4 to 36 carbon atoms such as maleic acid, fumaric acid, and citraconic acid, and alicyclic dicarboxylic acids having 6 to 40 carbon atoms such as dimer acid (dimerized linolic acid).

There is no specific limit to the aromatic dicarboxylic acids.

Specific examples thereof include, but are not limited to, aromatic dicarboxylic acids having 8 to 36 carbon atoms such as phthalic acid, isophthalic acid, terephthalic acid, t-butyl isophthalic acid, 2,6-naphthalene dicarboxylic acid, and 4,4'-biphenyl dicarboxylic acid.

Specific examples of the polycarboxylic acids having three or more hydroxyl groups include, but are not limited to, aromatic polycarboxylic acids having 9 to 20 carbon atoms (e.g., trimellitic acid and pyromellitic acid).

As the dicarboxylic acid or polycarboxylic acids having three or more hydroxyl groups, anhydrides of the compounds specified above or lower alkyl esters (e.g., methyl esters, ethyl esters, or isopropyl esters) having one to four carbon atoms can be used.

Among these dicarboxylic acids, it is particularly preferable to use the aliphatic dicarboxylic acids (preferably adipic acid, sebacic acid, dodecane dicarboxylic acid, terephthalic acid, and isophthalic acid) singly.

Using copolymers of the aliphatic dicarboxylic acids and the aromatic dicarboxylic acids (preferably isophthalic acid, terephthalic acid, t-butyl isophthalic acid, and lower alkyl esters thereof) is also preferable.

The amount of copolymerized aromatic dicarboxylic acid is preferably 20% by mol or less.

The polyester resin using the lactone ring-opening polymer is described in detail next.

There is no specific limit to the lactone ring-opening polymers.

Specific examples thereof include, but are not limited to, lactone ring-opening polymers obtained by ring-opening polymerizing a lactone such as a monolactone (the number of ester groups is one in the ring) having 3 to 12 carbon atoms such as β-propio lactone, γ-butylo lactone, δ-valero lactone, and ϵ-capro lactone using a catalyst such as a metal oxide and an organic metal compound and lactone ring-opening polymers having hydroxyl groups at their ends obtained by ring-opening polymerizing the monolactone having 3 to 12 carbon atoms mentioned above by usint a glycol (e.g., ethylene glycol and diethylene glycol) as an initiator.

There is no specific limit to the monolactone having 3 to 12 carbon atoms.

It is preferable to use ϵ-capro lactone in terms of crystallinity.

Products of lactone ring-opening polymers available from the market can be also used.

These are, for example, high-crystalline polycapro lactones such as PLACCEL series H1P, H4, H5, and H7 (manufactured by DAICEL CORPORATION).

Preparation of the polyhydroxy carboxylic acids is described next.

There is no specific limit to the preparation method of the polyhydroxy carboxylic acids.

Such polyhydroxy carboxylic acids as the polyester resins are obtained by, for example, a method of direct dehydrocondensation of hydroxycarboxylic acid such as a glycolic acid, lactic acid (L-, D- and racemic form); and a method of ring-opening a cyclic ester (the number of ester groups in the ring is two or three) having 4 to 12 carbon atoms corresponding to an inter two or three molecule dehydrocondensed compound of a hydroxycarboxylic acid such as glycolide and lactide (L-, D- and racemic form) with a catalyst such as a metal oxide and an organic metal compound.

The method of ring-opening is preferable in terms of controlling the molecular weight.

Among these, preferable cyclic esters are L-lactide and D-lactide in light of crystallinity.

In addition, these polyhydrocarboxylic acids that are modified to have a hydroxyl group or a carboxyl group at the end are also suitable.

Polyurethane Resin

Next, the polyurethane resins that can be used in the crystalline resin of the present disclosure are described.

The polyurethane resins are synthesized by polyols such as diols or tri- or higher alcohols and polyisocyanates such as diisocyanates or tri- or higher isocyanates.

Among these, it is preferable to use a polyurethane resin synthesized by a diol and a diisocyanate.

The polyols such as the diols and tri- or higher polyols specified above for the polyester resins described above are preferably used as the polyols such as the diols and tri- or higher polyols.

Isocyanates to react the diols are, for example, isocyanates or tri- or higher isocyanates.

There is no specific limit to the diisocyanates.

Specific examples thereof include, but are not limited to, aromatic diisocyanates, aliphatic diisocyanates, alicyclic diisocyanates, and aromatic aliphatic diisocyanates. Among these, aromatic diisocyanates having 6 to 20 carbon atoms, aliphatic diisocyanates having 2 to 18 carbon atoms, alicyclic diisocyanates having 4 to 15 carbon atoms, aromatic aliphatic diisocyanates having 8 to 15 carbon atoms, modified diisocyanates thereof (modified compounds having a urethane group, a cabodiimide group, an allophanate group, a urea group, a biuret group, a uretdione group, a uretimine group, an isocyanulate group, and an oxazoline group) are preferable, in which the number of carbon atoms excludes the number of carbon atoms in NCO group.

These can be used alone or in combination.

Optionally, tri- or higher isocynates can be used in combination.

There is no specific limit to the aromatic diisocyanates.

Specific examples thereof include, but are not limited to, 1,3- and/or 1,4-phenylene diisocyanate, 2,4- and/or 2,6-tolylene diisocyanate (TDI), crude TDI, 2,4'- and/or 4,4'-diphenyl methane diisocyanate (MDI), crude MDI, 1,5-naphtylene diisocyanate, 4,4'4"-triphenyl methane triisocyanate, and m- or p-isocyanato phenyl sulfonyl isocyanate.

There is no specific limit to the aliphatic diisocyanates.

Specific examples thereof include, but are not limited to, ethylene diisocyanate, tetramethylene diisocyanate, hexamethylene diisocyanate (HDI), dodecamethylene diisocyanate, 1,6,11-undecane triisocyanate, 2,2,4-trimethyl hexamethylene diisocyanate, lysine diisocyanate, 2,6-diisocyanato methyl caproate, bis(2-isocyanato ethyl)fumarate, bis(2-isocyanato ethyl)carbonate, and 2-isocyanatoethyl-2,6-diisocyanato hexanoate.

There is no specific limit to the alicyclic diisocyanates.

Specific examples thereof include, but are not limited to, isophorone diisocyanate (IPDI), dicyclo hexyl methane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5- and/or 2,6-norbornane diisocyanate.

There is no specific limit to the aromatic aliphatic diisocyanates.

Specific examples thereof include, but are not limited to, m- and/or p-xylylene diisocyanate (XDI), α,α,α',α'-tetramethyl xylylene diisocyanate (TMXDI).

Specific examples of the modified compounds of the diisocyanates include, but are not limited to, modified compounds having a urethane group, a cabodiimide group, an allophanate group, a urea group, a biuret group, a uretdione group, a uretimine group, an isocyanulate group, and an oxazolidone group.

To be specific, these are: modified MDI such as urethane modified MDI, carbodiimide modified MDI, and trihydrocarbyl phosphate modified MDI), modified compounds of diisocyanates such as urethane modified TDI such as a prepolymer containing an isocyanate group, and mixtures thereof such as modified MDI and urethane modified TDI.

Among these, aromatic diisocyanates having 6 to 15 carbon atoms, aliphatic diisocyanates having 4 to 12 carbon atoms, alicyclic diisocyanates having 4 to 15 carbon atoms are preferable, in which the number of carbon atoms excludes the number of carbon atoms in NCO group.

Among these, TDI, MDI, HDI, hydrogenated MDI, and IPDI are particularly preferable.

Polyurea Resin

Next, the polyurea resins that can be used in the crystalline resin of the present disclosure are described.

The polyurea resins are synthesized by polamines such as diamines or tri- or higher amines and polyisocyanates such as diisocyanates or tri- or higher isocyanates. Among these, it is preferable to use a polyurea resin synthesized by a diamine and a diisocyanate.

The polyisocyanates such as diisocyanates and tri- or higher isocyanates specified above for the polyurethane resins described above are preferably used as the polyisocyanates such as diisocyanates and tri- or higher isocyanates.

Specific examples of the polyamines include, but are not limited to, diamines and tri- or higher amines.

There is no specific limit to the diamines.

Specific examples thereof include, but are not limited to, aliphatic diamines and aromatic amines. Among these, aliphatic diamines having 2 to 18 carbon atoms and aromatic diamines having 6 to 20 carbon atoms are suitable.

Optionally, tri- or higher amines can be used.

There is no specific limit to the aliphatic diamines having 2 to 18 carbon atoms.

Specific examples thereof include, but are not limited to, alkylene diamines having 2 to 6 carbon atoms such as ethylene diamine, propylene diamine, trimethylene diamine, tetramethylene diamine, and hexamethylene diamine; polyalkylene diamines having 4 to 18 carbon atoms such as diethylene triamine, iminobis propyl amine, bis(hexamethylene)triamine, triethylene tetramine, tetraethylene pentamine, and pentaethylene hexamine; alkyl substituted compounds of alkylene diamine or polyalkylene diamine in which the number of carbon atoms of the alkyl is from 1 to 4 or hydroxyalkyl substituted compounds of alkylene diamine or polyalkylene diamine in which the number of carbon atoms of the hydroxyalkyl is from 2 to 4 such as dialkyl aminopropyl amine, trimethyl hexamethylene diamine, aminoethyl ethanol amine, 2,5-dimethyl-2,5-hexamethylene diamine, and methyl iminobis(propyl amine); alicyclic diamines having 4 to 15 carbon atoms such as 1,3-diamino cyclehexane, isophorone diamine, menthene diamine, 4,4'-methylene dicyclohexane diamine(hydrogenated methylene dianiline; heterocyclic aliphatic diamines having 4 to 15 carbon atoms such as piperazine, N-aminoethyl piperazine, 1,4-diaminoethyl piperazine, 1,4,-bis(2-amino-2-methylpropyl) piperazine, 3,9-bis(3-aminopropyl)-2,4,8,10-tetraoxaspiro[5,5]undecane; and aromatic ring-containing aliphatic diamines having 8 to 15 carbon atoms such as xylylene diamine, and tetrachlor-p-xylylene diamine.

Specific examples of the aromatic diamines having 6 to 20 carbon atoms include, but are not limited to, non-substituted aromatic diamines such as 1,2-, 1,3, or 1,4-phenylene diamine, 2,4,'- or 4,4'-diphenyl methane diamine, crude diphenyl methane diamine(polyphenyl polymethylene polyamine), diaminodiphenyl sulfone, bendidine, thiodianiline, bis(3,4-diaminophenyl)sulfone, 2,6-diaminopilidine, m-aminobenzyl amine, triphenyl methane-4,4',4"-triamine, and naphtylene diamine; aromatic diamines having a nuclear substitution alkyl group having one to four carbon atoms such as 2,4- or 2,6-tolylene diamine, crude tolylene diamine, diethyle tolylene diamine, 4,4'-diamino-3,3'-dimethyldiphenyl methane, 4,4'-bis(o-toluidine), dianisidine, diamino ditolyl sulfone, 1,3-dimethyl-2,4-diaminobenzene, 1,3-dimethyl-2,6-diaminobenzene, 1,4-diisopropyl-2,5-diamino benzene, 2,4-diamino mesitylene, 1-methyl-3,5-diethyl-2,4-diamino benzene, 2,3-dimethyl-1,4-diamino naphthalene, 2,6-dimethyl-1,5-diamino naphthalene, 3,3',5,5'-tetramethyl bendizine, 3,3',5,5'-tetramethyl-4,4'-diamino diphenyl methane, 3,5-diethyl-3'-methyl-2',4-diamino diphenyl methane, 3,3' diethyl-2,2'-diaminodiphenyl methane, 4,4'-diamino-3,3'-dimethyl diphenylmethane, 3,3',5,5'-tetra-ethyl-4,4'-diaminobenzophenone, 3,3',5,5'-tetraethyl-4,4'-diaminodiphenylether, 3,3',5,5'-tetraisopropyl-4,4'-diaminophenylsulfone; mixtures of isomers of non-substituted aromatic diamines and aromatic diamines having a nuclear substitution alkyl group having one to four carbon atoms; aromatic diamines having a nuclear substitution electron withdrawing group (such as halogen (e.g., Cl, Br, I, and F), alkoxy groups such as methoxy group and ethoxy group, and nitro group) such as methylene bis-o-chloroaniline, 4-chloro-phenylene diamine, 2-chlor-1,4-phenylene diamine, 3-amino-4-chloroaniline, 4-bromo-1,3-phenylene diamine, 2,5-dichlor-1,4-phenylene diamine, 5-nitro-1,3-phenylene diamine, 3-dimethoxy-4-aminoaniline; 4,4'-diamino-3,3'-dimethyl-5,5'-dibromo-diphenyl methane, 3,3'-dichlorobenzidine, 3,3' dimethoxy benzidine, bis(4-amino-3-chlorophenyl)oxide, bis(4-amino-2-chlorophenyl)propane, bis(4-amino-2-chlorophenyl) sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylene bis(2-iodoaniline), 4,4'-methylene bis(2-bromoaniline), 4,4'-methylene bis(2-fluoroaniline), 4-aminophenyl-2-chloroaniline); aromatic diamines having a secondary amino group such as the non-substituted aromatic diamines specified above, the aromatic diamines having a nuclear substitution alkyl group having one to four carbon atoms, mixtures of isomers thereof, compounds in which part or entire of the primary amine group of the aromatic diamines having a nuclear substitution electron withdrawing group specified above is substituted with a lower alkyl group such as methyl group and ethyl group to be a tertiary amino group, 4-4'-di(methylamino)diphenyl methane, and 1-methyl-2-methylamino-4-aminobenzene.

In addition to those, specific examples of the other diamines include, but are not limited to, polyamide polyamines (such as low-molecular weight polyamide polyamines obtained by condensation of dicarboxylix acid (e.g., dimeric acid) and excessive (2 mols or more per mol of acid) polyamines (e.g., the alkylene diamines and polyalkylene polyamines) and polyether polyamines such as hydrogenetaed compounds of cyanoethylated polyether polyols (e.g., polyalkeylene glycol).

Polyamide Resin

There is no specific limit to the crystalline polyamide resins having a urethane bond and/or urea bond can be used as the binder resin for use in the colorless transparent toner of the present disclosure.

The polyamide resins are synthesized by, for example, polyamines such as diamines or tri- or higher amines and polycarboxylic acids such as dicarboxylic acids or tri- or higher carboxylic acids. Among these, it is preferable to use a polyamide resin synthesized by a diamine and a dicarboxylic acid.

The polyamines such as diamine and tri- or higher amines specified above for the polyurea resins described above are preferably used as the polyamines such as the diamines or tri- or higher amines.

The polycarboxylic acids such as dicarboxylic acids and tri- or higher carboxylic acids specified above for the polyester resins described above are preferably used as the opolycarboxylic acids such as dicarboxylic acids or tri- or higher carboxylic acids.

Polyether Resin

The crystalline polyether resin having a urethane bond and/or urea bond can be used in the binder resin for use in the colorless transparent toner of the present disclosure.

There is no specific limit to the polyether resins.

A specific example thereof is a crystalline polyoxyalkylene polyol.

There is no specific limit to the manufacturing method of the crystalline polyoxyalkylene polyol.

For example, Journal of the American Chemical Society published in 1956 (in pages 4,787 to 4,792 in No. 18, Vol. 78) described a method of ring-opening polymerization of a chiral AO using a catalyst used in the polymerization of AO by man in the art.

The method of ring-opening a racemic AO is also usable.

To be specific, JP-H11-12353-A describes a method using a compound obtained by contacting a lantanoid complex and an organic aluminum as a catalyst and JP-2001-521957-A describes a method of preliminarily conducting reaction between bimetal p.-oxo alkoxide and a hydroxyl compound.

Also, Journal of the American Chemical Society published in 2005 described a suitable method using a salen complex as a catalyst to obtain a crystalline polyoxyalkylene polyol having a high isotacticity in pages 11,566 to 11,567 in No. 33, Vol. 127.

For example, when using a glycol or water as an initiator during ring-opening polymerization using a chiral AO, a polyoxyalkylene glycol having a hydroxyl group at its end with 50% or more isotacticity can be obtained.

The polyoxyalkylene glycol with 50% or more isotacticity can be modified to have a carboxyl group at its end.

By using the manufacturing method of polyoxyalkylene glycol with 50% or more isotacticity, a polyether resin having a high crystallinity is easily obtained.

As the glycol, the glycols specified above are usable.

As the carboxylic acid for carboxylic-modification, the dicarboxylic acids specified above are usable.

The AOs for use in manufacturing the crystalline polyoxyalkylene polyols preferably have 3 to 9 carbon atoms.

Specific examples thereof include, but are not limited to, PO, 1-chlorooxetane, 2-chlorooxetane, 1,2-dichlorooxetane, epichlorohydrin, epibromohydrin, 1,2-BO, methyl glycidyl ether, 1,2-penthylene oxide, 2,3-penthylene oxide, 3-methyl-1,2-buthylene oxide, cyclohexene oxide, 1,2-hexylene oxide, 3-methyl-1,2-pentylene oxide, 2,3-hexylene oxide, 4-methyl-2,3-penthylene oxide, aryl glycidyl ether, 1,2-heptylene oxide, styrene oxide, and phenyl glycidyl ether.

Among these AOs, it is preferable to use PO,1,2-BO, styrene oxide, and cyclohexene oxide and, more preferable, PO, 1,2-BO, and cyclohexene oxide.

These AOs can be used alone or in combination.

In addition, the isotacticity of the crystalline polyoxyalkylene polyol is preferably 70% or higher, more preferably 80% or higher, furthermore preferably 90% or more, and particularly furthermore preferably 95% or more in terms of the sharp melting property and the blocking resistance of the obtained crystalline polyether resin.

The isotacticity in the present disclosure can be calculated by, for example, the method described in pages 2,389 to 2,392 of No. 6, Vol. 35, Macromolucules published in 2002.

Its brief description is as follows.

Weigh about 30 mg of a measuring sample in a sample tube for 13C-NMR having a diameter of 5 mm and dissolve the sample in about 0.5 ml of a deuterated solvent to prepare a sample for analysis.

Any deuterated solvent that can dissolve the sample is suitably usable.

Specific examples thereof include, but are not limited to, deuteratedchloroform, deuterated toluene, deuterated dimethyl sulfoxide, and deuterated dimethyl form amide. The signals deriving from three kinds of methines of 13C-NMR are observed around 75.1 ppm (syndiotactic value (S)), 75.3 ppm (heterotactic value (H)), and 75.5 ppm (isotactic value (I)).

The isotacticity can be calculated by the following relation 1:

$$\text{Isotacticity}(\%)=[I/(I+S+H)]\times 100 \qquad \text{Relation 1}$$

In the Relation 1, I represents an integration value of the isotactic signal, S represents an integration value of the syndiotactic signal, and H represents an integration value of the heterotactic signal.

Polyvinyl Resin

The crystalline polyvinyl resin having a urethane bond and/or urea bond can be used in the binder resin for use in the colorless transparent toner of the present disclosure.

There is no specific limit to the polyvinyl resin.

It is possible to use a polyvinyl resin having a crystalline vinyl monomer as the structure unit.

Also, it is possible to contain a non-crystalline vinyl monomer as the structure unit.

There is no specific limit to the crystalline vinyl monomer.

Specific examples thereof include, but are not limited to, straight chain alkyl (meth)acrylate (in which a straight chain alkyl group having 12 to 50 carbon atoms is a crystalline group) such as lauryl (meth)acrylate, tetradecyl(meth)acrylate, stearyl (meth)acrylate, eicosyl(meth)acrylate, and behenyl(meth)acrylate.

There is no specific limit to the non-crystalline vinyl monomer.

It is preferable to use a vinyl monomer having a molecular weight of 1,000 or less. Specific examples thereof include, but are not limited to, (meth)acrylic monomers, vinyl monomers having carboxylic groups, other vinyl ester monomers, and aliphatic hydrocarbon-based vinyl monomers.

These can be used alone or in combination.

There is no specific limit to the styrenes.

Specific examples thereof include, but are not limited to, styrene and alkylstyrenes having an alkyl group having 1 to 3 carbon atoms.

There is no specific limit to the (meth)acrylate monomers.

Specific examples thereof include, but are not limited to, alkyl (meth)acrylates having an alkyl group having 1 to 11 carbon atoms and alkyl (meth)acrylates having a side chain with an alkyl group having 12 to 18 carbon atoms such as methyl (meth)acrylate, ethyl (meth)acrylate, butyl (meth) acrylate, and 2-ethylhexyl(meth)acrylate; hydroxy alkyl (meth)acrylate having an alkyl group having 1 to 11 carbon atoms such as hydroxyethyl(meth)acrylate; and (meth)acrylates containing an alkyl amino group having an alkyl group having 1 to 11 carbon atoms such as dimethyl amino ethyl (meth)acrylate and diethyl amino ethyl (meth)acrylate.

There is no specific limit to the vinyl monomer having a carboxylic group.

Specific examples thereof include, but are not limited to, monocarboxylic acids such as (meth)acrylic acid, crotonic acid, and cinnamic acid; dicarboxylic acids having 4 to 15 carbon atoms such as maleic anhydride, maleic acid, fumaric acid, itaconic acid, and citraconic acid; and dicarboxylic acid monoesters such as monoalkyl (C1 to C18) esters of the dicarboxylic acids specified such as maleic acid monoalkyl esters, fumaric acid monoalkyl esters, itaconic acid monoalkyl esters, and citraconic acid monoalkyl esters.

There is no specific limit to the other vinylester monomers.

Specific examples thereof include, but are not limited to, aliphatic vinyl esters having 4 to 15 carbon atoms such as vinyl acetate, vinyl propionate, isopropenyl acetate; unsaturated carboxylic acid (di- or higher) alcohol esters having 8 to 50 carbon atoms such as ethylene glycol di(meth)acrylate, propylene glycol di(meth)acrylate, neopentyl glycol di(meth) acrylate, trimethylol propane tri(meth)acrylate, 1,6-hexane diol diacrylate, and polyethylene glycol di(meth)acrylate; and aromatic vinyl esters having 9 to 15 carbon atoms such as methyl-4-vinyl benzoate.

There is no specific limit to the aliphatic hydrocarbon-based vinyl monomers.

Specific examples thereof include, but are not limited to, olefines having 2 to 10 carbon atoms such as ethylene, propylene, butane, and octen; and diens having 4 to 10 carbon atoms such as butadiene, isoplene, and 1,6-hexadien.

Urethane-Modification and/or Urea-Modification

In the crystalline resin (resin having a urethane-modification and/or urea modification) having a urethane bond and/or a urea bond, the urethane-modified crystalline resin is the crystalline resin specified above and can be obtained by, for example, reaction between a resin having an isocyanate group at its end and a polyol.

The urea-modified crystalline resin is the crystalline resin specified above and it can be obtained by reaction between a resin having an isocyanate group at its end with an amine compound.

To be specific, the urethane-modified crystalline resin is obtained by mixing and reacting a resin having an isocyante group, a resin having a polyol, etc., and a compound such as a cross-linking agent or an elongation agent to increase the molecular weight of the resin in the manufacturing process of the colorless transparent toner.

In addition, the urea-modified crystalline resin is obtained by mixing and reacting a resin having an isocyante group, a resin having an amine, etc., and a compound such as a cross-linking agent or an elongation agent to increase the molecular weight of the resin in the manufacturing process of the colorless transparent toner.

As an example of the methods of manufacturing the crystalline resin having a urethane bond and/or a urea bond, a method of manufacturing acrystalline polyester resin having a urethane bond is described below.

It is possible to manufacture a crystalline polyester resin having a urethane bond by adding a di- or higher isocyanate compound to conduct elongation and/or cross-linking reaction in the polycondensation reaction between the alcohol component and the carboxylic acid component mentioned above.

Normally, the amount of the di- or higher isocyanate compound is less than that of the alcohol component.

The elongation and/or cross-linking reaction proceeds by elongation and/or cross-linking reaction of the alcohol component and the isocyanate component.

The elongation and/or cross-linking reaction is controlled by adjusting the amount of the alcohol component and the amount of the di- or higher isocyanate compound of the crystalline polyester resin.

In addition, the crystalline resin having a urethane bond and/or a urea-bond can be synthesized by the following method. First, when conducting the polycondensation reaction between the alcohol component and the carboxylic component, which constitute the crystalline polyester resin, the crystalline resin (relatively small molecular weight) having an isocyanate group at its end is synthesized by adding an ample amount of the di- or higher isocyanate compound.

Thereafter, it is possible to increase the molecular weight of the crystalline resin by reacting this crystalline resin having an isocyanate group at its end with a polyol or a polyamine (or a cross-linking agent and an elongation agent).

In this case, the crystalline resin mentioned above having an isocyanate group at its end is used as a precursor of the crystalline resin in the toner manufacturing process.

With regard to the manufacturing method of toner, it is preferable to use a modified crystalline resin having an isocyanate group at its end.

In the manufacturing method of the colorless transparent toner described later, it is preferable to form a binder resin by conducting elongation and/or cross-linking reaction by reacting this isocyante group and a hydroxyl group (alcoholic hydroxyl group and a phenolic hydroxyl group) or an amine compound during granulation of colorless transparent toner particles by dispersion and/or emulsification in an aqueous medium.

Among these, using urethane-modified polyester resins obtained by elongation and/or cross-linking reaction of a polyester resin having an isocyanate group at its end and a polyol; and urea-modified polyester resins obtained by elongation and/or cross-linking reaction of a polyester resin having an isocyanate group at its end and a polyamine compound is preferable.

It is preferable to use the urea-modified polyester resins obtained by elongation and/or cross-linking reaction of a polyester resin having an isocyanate group at its end and a polyamine compound taking into account the reaction speed.

There is no specific limit to the amines.

Specific examples thereof include, but are not limited to, phenylene diamine, diethyltoluene diamine, 4,4'-diamino diphenyl methane, 4,4'-diamino-3,3'-dimethyldicyclo hexylmethane, diamine cyclohexane, isophorone diamine, ethylenediamine, tetramethylene diamine, hexamethylene dimaine, diethylene triamine, triethylene tetramine, ethanol amine, hydroxyethyl aniline, aminoethyl mercaptan, aminopropyl meracaptan, amino propionic acid, and amino caproic acid.

In addition, ketimine compounds and oxazolidone compounds in which these amino groups of the amines are blocked with ketones (acetone, methylethyl ketone, and methylisobutyl ketone) are also suitable.

It is possible to use a block resin having a crystalline portion and a non-crystalline portion as the binder resin for use in the present disclosure.

As the entire block resin, it is preferable to satisfy the requisite of the crystallinity described above and the crystalline resin preferably accounts for 50% by weight or more in the total amount of the binder resin.

There is no specific limit to the resins for use in forming the non-crystalline portion.

Specific examples thereof include, but are not limited to, polyester resins, polyurethane resins, polyurea resins, polyamide resins, polyether resins, vinyl resins such as polystyrene acrylic-based polymers, and epoxy resins.

As the crystalline portion, as described above, it is preferable to use polyester resins, polyurethane resins, polyurea resins, polyamide resins, and polyether resins.

With regard to the non-crystalline portion, it is preferable to use polyester resins, polyurethane resins, polyurea resins, polyamide resins, polyether resins, and complex resins thereof in terms of the compatibility. It is preferable to use polyurethane resins or polyester resins as the resins for the non-crystalline portion.

There is no specific limit to the composition of the resins for the non-crystalline portion.

Specific examples thereof include, but are not limited to, polyols, polycarboxylic acids, polyisocyanates, polyamines, and AOs.

Non-Crystalline Resin

The binder resin of the present disclosure may contain non-crystalline resin if the binder resin contains a crystalline resin in an amount of 50% by weight or more of the total amount of the binder resin.

There is no specific limit to the non-crystalline resin.

Specific examples thereof include, but are not limited to, styrene polymers and substituted styrene polymers such as polystyrene, poly-p-styrene, and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ether copolymers, styrene-vinyl methyl ketone copolymers, styrene-butadiene copolymers, styrene-isopropyl copolymers, and styrene-maleic acid ester copolymers; and other resins such as polymethyl methacrylate, polybutyl methacrylate, polyvinyl chloride, polyvinyl acetate, polyethylene, polyesters, epoxy resins, polyurethane resins, polyvinyl butyral resins, polyacrylic resins, rosin, modified rosins, terpene resins, phenol resins, aliphatic or aromatic hydrocarbon resins, aromatic petroleum resins, and the resins specified above which are modified to have a functional group reactive with an active hydrogen group.

These can be used alone or in combination.

Organic-Modified Laminar Inorganic Minerals

In the organic-modified laminar inorganic minerals, organic ions are at least partially substituted for ions present between layers of the organic-modified inorganic laminar compound.

Normally, the laminar inorganic mineral represents an inorganic mineral having multiple overlapped layers each of which has a thickness of several nm.

"Modified" means introducing organic ions into ions present between the layers of the laminar inorganic minerals and intercalation in a broad sense.

Arrangement of the organic-modified laminar inorganic minerals close to the surface layer of toner efficiently improves the structural viscosity of the binder resin close to the surface layer and ameliorates stress-resistance of the toner.

How the organic-modified laminar inorganic minerals are present in the toner can be confirmed by observing the cross section obtained by slicing a sample of the toner particle embedded in, for example, an epoxy resin, by using a microtome or an ultramicrotome by a scanning electron microscope (SEM).

In a case of the observation by an SEM, it is preferable to use a reflection electron image to observe the presence of the organic-modified laminar inorganic minerals in a contrasty condition.

Also, it is suitable to observe the cross-section of toner by slicing a sample of the toner particle embedded in, for example, an epoxy resin, by ion beams using FIB-STEM (HD-2000, manufactured by HITACHI LIMITED), etc.

Also, using a reflection electron image is preferable in terms of easiness of observation.

"close to the surface layer of toner" represents an area ranging from 0 nm to 300 nm from the uppermost surface of toner to the inside thereof in the observed image of the cross section of the toner obtained by slicing a sample of the toner particle embedded in, for example, an epoxy resin, by a microtome, an ultramicrotome, or FIB-STEM.

There is no specific limit to the selection of the laminar inorganic minerals.

Specific examples thereof include, but are not limited to, smectite group clay minerals such as montmorillonite, saponite, and hectorite; kaolin group clay minerals such as kaolinite; bentonite, attapulgite, magadiite, and kanemite.

These can be used alone or in combination.

There is no specific limit to the selection of the organic ions.

Specific examples thereof include, but are not limited to, quaternary ammonium ion; phosphonium ion; imidazolium ion; and sulfuric acid ion, sulfonic acid ion, carboxylic acid ion, and phosphoric acid ion which have a branched-, non-branched, or cyclic alkyl skeleton having 1 to 44 carbon atoms, a branched-, non-branched, or cyclic alkenyl skeleton having 1 to 22 carbon atoms, branched-, non-branched, or cyclic alkoxy skeleton having 8 to 32 carbon atoms, branched-, non-branched, or cyclic hydroxy alkyl skeleton having 2 to 22 carbon atoms, ethylene oxide skeleton, or a propylene oxide skeleton.

These can be used alone or in combination.

Specific examples of the quaternary ammonium ion include, but are not limited to, trimethyl stearyl ammonium ion, dimethyl stearyl benzyl ammonium ion, dimethyl octadecyl ammonium ion, and oleyl bis(2-hydroxyethyl) methyl ammonium ion.

An organic-modified laminar inorganic compound is also suitable in which at least part of the divalent metal ion present between the layers is substituted by a trivalent metal ion to introduce an inorganic anion and at least part of the inorganic anion is substituted by an organic anion.

Specific examples of the marketed products of the organic-modified laminate inorganic compounds include, but are not limited to, quaternium 18/bentonite such as BENTONE 3, BENTONE 38 (both manufactured by RHEOX INTERNATIONAL INCORPORATED), THIXOGEL VP (manufactured by UNITED CATALYST), CLAYTONE 34, CLAYTONE 40, and CLAYTONE XL (manufactured by SOUTHERN CLAY PRODUCTS, INC.); stearalconium bentonite such as BENTONE 27 (manufactured by RHEOX INTERNATIONAL INCORPORATED), THIXOGEL1 LG (manufactured by united catalyst), CLAYTONE AF and C1LAYTONE APA (manufactured by SOUTHERN CLAY PRODUCTS, INC.); QUANTERNIUM 18/benzalconium bentonite such as C1LAYTONE HT and C1LAYTONE PS (manufactured by SOUTHERN CLAY PRODUCTS, INC.); organic-modified montmorillonite such as CLAYTONEE HY (manufactured by SOUTHERN CLAY PRODUCTS, INC.); and organic-modified smectites such as LUCENTITE SPN (manufactured by CO-OP CHEMICAL CO., LTD.)

The organic-modified laminate inorganic compounds can be used in combination with a resin as a master batch.

The content of the organic-modified laminate inorganic compounds is preferably from 0.1% by weight to 3.0% by weight, more preferably from 0.5% by weight to 2.0% by weight, and furthermore preferably from 1.0% by weight to 1.5% by weight.

When the content of the organic-modified laminate inorganic compounds in the toner is too small, the organic-modified laminate inorganic compounds may not exhibit their features.

On the other hand, when the content of the organic-modified laminate inorganic compounds in the toner is too large, the low temperature fixing property tends to deteriorate.

Method of Manufacturing Colorless Transparent Toner

There is no specific limit to the method of manufacturing the colorless transparent toner of the present disclosure and any known manufacturing method is suitably usable if the binder resin contains a crystalline resin having a urethane bond and/or a urea bond.

The colorless transparent toner may contain other components.

In addition, when manufacturing a set of the colorless transparent toner of the present disclosure and toner containing a coloring agent, any known manufacturing method is suitably used to manufacture the toner containing the coloring agent.

Specific examples of the known methods of manufacturing toner include, but are not limited to, the mixing, kneading, and pulverization method and the chemical method. The chemical method is preferable to granulate crystalline resins easily and arrange the laminar inorganic minerals described above close to the surface layer of toner.

Mixing, Kneading, and Pulverization Method

The mixing, kneading, and pulverization method, for example, melts and mixes, and kneads a toner material containing a binder resin, a laminar inorganic minerals, and a coloring agent (when manufacturing a toner set) followed by pulverization and classification to obtain mother particles.

In the melting, mixing, and kneading, the toner material is mixed and placed in a melting, mixing, and kneading machine for melting, mixing, and kneading.

Single-screw or twin-screw continuous mixing and kneading machines or batch type mixing and kneading machines by a roll mill can be used as the melting and mixing and kneading machine.

Specific examples thereof include, but are not limited to, KTK type twin-screw extruders (manufactured by KOBE STEEL., LTD.), TEM type extruders (manufactured by TOSHIBA MACHINE CO., LTD.), twin-screw extruders (manufactured by KCK), PCM type twin-screw extruders (manufactured by IKEGAI CORP.), and Ko-kneaders (manufactured by Buss).

It is preferable to conduct the melting and mixing and kneading under conditions in which the molecular chain of the binder resin is not severed.

To be specific, man in the art can determine the melting and mixing and kneading temperature based on the softening point of the binder resin.

When the melting and mixing and kneading temperature is excessively higher than the softening point, the molecular chains are easily severed.

When the melting and mixing and kneading temperature is excessively lower than the softening point, In the pulverization process, the mixture obtained in the mixing and kneading is pulverized.

In the pulverization process, it is preferable to coarsely pulverize the mixed and kneaded materials first followed by fine pulverization.

In this process, it is preferable that the mixed and kneaded mixtures are pulverized by collision with a collision board in a jet stream, collision between particles in a jet stream, and pulverization at narrow gaps between a stator and a rotor that is mechanically rotating, etc.

The classification process is an adjusting process of classifying the pulverized material obtained in the pulverization process to prepare particles having a predetermined particle diameter.

The classification can be performed by removing particulate portions using a cyclone, a decanter, or a centrifugal.

After the pulverization and classification, the pulverized material is classified in an air stream by centrifugal, etc. to manufacture mother toner particles having a predetermined particle diameter.

Chemical Method

Specific examples of the chemical manufacturing method of granulating toner particles in an aqueous medium include, but are not limited to, a suspension polymerization method, emulsification polymerization method, a seed polymerization method, and a dispersion polymerization method that manufacture a toner using a monomer as the initial material, a dissolution suspension method of dissolving a resin precursor and a resin followed by dispersion and/or emulsification in an aqueous medium, a phase change emulsification method of adding water to a solution containing a resin, a resin precursor, and a suitable emulsifier, and an agglomeration method of granulating particles having desired size by agglomerating the resin particles obtained by these methods which are dispersed in the aqueous medium followed by heating, melting, etc.

Among these, the dissolution suspension method is preferable in light of the granularity (easiness of controlling the particle size distribution, controlling of particle forms, etc.) of the crystalline resin and the arrangement of the organic-modified laminar inorganic mineral closer to the surface layer of the toner.

There is no specific limit to the chemical method.

A method is preferable which includes granulating the mother toner particles mentioned above by dispersing and/or emulsifying a toner component containing at least a binder resin, a coloring agent (when manufacturing a toner set), the organic-modified laminar inorganic mineral in an aqueous medium.

The toner of the present disclosure is preferable which is obtained by granulating by dispersing and/or emulsifying at least the binder resin, the coloring agent, and the organic-modified laminar inorganic mineral particulates in an aqueous medium.

There is no specific limit to the method of manufacturing resin particulates containing the binder resin described above.

Specific examples thereof include, but are not limited to, the following (a) to (h):

(a) A method of manufacturing an aqueous liquid dispersion of the resin particulate directly from the polymerization reaction by a suspension polymerization method, an emulsification polymerization method, a seed polymerization method, or a dispersion polymerization method from a monomer as the initial material in the case of a vinyl based resin.

(b) A method of manufacturing an aqueous dispersion element of resin particulates by: dispersing a precursor (monomer, oligomer, etc.) or its solvent solution under the presence of a suitable dispersion agent; and curing the resultant by heating and/or adding a curing agent in the case of a polyaddition or polycondensation resin such as a polyester resin, a polyurethane resin and an epoxy resin.

(c) A method of phase change emulsification of dissolving a suitable emulsification agent in a precursor (monomer, oligomer, etc.) or its solvent solution (liquid is preferred, solution liquidized by heating is also allowable) followed by adding water for phase change in the case of a polyaddition or polycondensation resin such as a polyester resin, a polyurethane resin and an epoxy resin.

(d) A method of pulverizing a resin preliminarily manufactured by a polymerization reaction (addition polymerization, ring scission polymerization, polyaddition, addition condensation, polycondensation, etc.) with a fine grinding mill of a mechanical rotation type or jet type, classifying the resultant to obtain resin particulates, and dispersing the resin particulates in water under the presence of a dispersion agent.

(e) A method of spraying a resin solution in which a preliminarily manufactured resin by a polymerization reaction (addition polymerization, ring scission polymerization, polyaddition, addition condensation, polycondensation, etc.) is dissolved in a solvent in a form of a fine liquid mist to obtain resin particulates followed by dispersion in water under the presence of a suitable dispersion agent.

(f) A method of adding a solvent to a resin solution in which a preliminarily manufactured resin by a polymerization reaction (addition polymerization, ring scission polymerization, polyaddition, addition condensation, polycondensation, etc.) is dissolved in a solvent or cooling down a resin solution preliminarily prepared by dissolving the resin in a solvent by heating to precipitate resin particulates; removing the solvent to obtain the resin particulates; and dispersing them in water under the presence of a dispersion agent.

(g) A method of dispersing a resin solution in which a preliminarily manufactured resin by a polymerization reaction (addition polymerization, ring scission polymerization, polyaddition, addition condensation, polycondensation, etc.) is dissolved in a solvent in an aqueous medium under the presence of a suitable dispersion agent; and removing the solvent by heating, reducing pressure, etc.

(h) A method of dissolving a suitable emulsifying agent in a resin solution in which a preliminarily manufactured resin by a polymerization reaction (addition polymerization, ring scission polymerization, polyaddition, addition condensation, polycondensation, etc.) is dissolved in a solvent; and adding water to the solution for phase change emulsification.

In addition, it is possible to use a surface active agent and a polymer protection colloid on emulsification and dispersion in an aqueous medium.

Surface Active Agent

There is no specific limit to the surface active agents.

Specific examples thereof include, but are not limited to, anionic dispersion agents, for example, alkylbenzene sulfonic acid salts, α-olefin sulfonic acid salts, and phosphoric acid salts; cationic dispersion agents, for example, amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersion agents, for example, fatty acid amide derivatives, polyhydric alcohol derivatives; and ampholytic dispersion agents, for example, alanine, dodecyldi(aminoethyl)glycin, di(octylaminoethyle) glycin, and N-alkyl-N,N-dimethylammonium betaine.

Dispersion is improved with an extremely small amount of a surface active agent having a fluoroalkyl group. Preferred specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{omega-fluoroalkyl (C6-C11) oxy}-1-alkyl (C3-C4) sulfonate, sodium 3-{omega-fluoroalkanoyl (C6-C8)-N-ethylamino}-1-propanesulfonate, fluoroalkyl (C11-C20) carboxylic acids and their metal salts, perfluoroalkylcarboxylic acids and their metal salts, perfluoroalkyl (C4-C12) sulfonate and their metal salts, perfluorooctanesulfonic acid diethanol amides, N-propyl-N-(2-hydroxyethyl)perfluorooctanesulfone amide, perfluoroalkyl (C6-C10) sulfoneamidepropyltrimethylammonium salts, salts of perfluoroalkyl (C6-C10)-N-ethylsulfonyl glycin, monoperfluoroalkyl (C6-C16) ethylphosphates, etc.

Specific examples of the cationic surface active agents having a fluoroalkyl group include, but are not limited to, primary and secondary aliphatic amino acids, secondary amino acids, aliphatic quaternary ammonium salts (for example, perfluoroalkyl (C6-C10) sulfone amidepropyltrimethyl ammonium salts), benzalkonium salts, benzetonium chloride, pyridinium salts, and imidazolinium salts.

Protection Colloid

Specific examples of such polymeric protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid, and maleic anhydride), (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethyleneglycolmonomethacrylic acid esters, glycerinmonoacrylic acid esters, N-methylolacrylamide and N-methylolmethacrylamide); vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide, and diacetoneacrylamide) and their methylol compounds, acid chlorides (e.g., acrylic acid chloride and methacrylic acid chloride); monomers having a nitrogen atom or a heterocyclic ring having a nitrogen atom (e.g., vinyl pyridine, vinyl pyrrolidone, vinyl imidazole, and ethylene imine); polyoxyethylene compounds (e.g., polyoxyethylene, polyoxypropylene, polyoxy ethylene alkyl amines, polyoxypropylene alkyl amines, polyoxy ethylenealkyl amides, polyoxypropylene alkyl amides, polyoxyethylene nonylphenyl ethers, polyoxyethylene lauryl phenyl ethers, polyoxyethylene stearylphenyl esters, and polyoxyethylene nonylphenyl esters), and cellulose compounds, for example, methyl cellulose, hydroxyethyl cellulose, and hydroxy propyl cellulose.

Organic Solvent

The organic solvent to dissolve or disperse the toner composition having a binder resin (and a precursor of the crystalline resin), etc. preferably has a boiling point lower than 100° C. in order to easily remove the organic solvent later.

Specific examples of such solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc.

These can be used alone or in combination. Among these, using ester based solvents such as methyl acetate and ethyl acetate, aromatic based solvent such as toluene and xylene, and halogenized hydrocarbons such as methylene chloride, 1,2-dichloroethane, chloroform, and carbon tetrachloride are preferable.

The solid portion of the oil phase obtained by dissolving or dispersing the toner composition having a binder resin (and a precursor of the crystalline resin), etc. preferably has a concentration of from 40% by weight to 80% by weight.

When the concentration of the solid portion is too high, the toner composition is not easily dissolved or dispersed, thereby increasing the viscosity, resulting in degrading the handle of ease.

When the concentration of the solid portion is too low, the amount of the manufactured toner tends to decrease.

Toner compositions other than the binder resin and a master batch thereof may be separately dissolved or dispersed in an organic solvent and thereafter mixed with the solution and/or liquid dispersion of the resin.

Aqueous Medium

Simple water can be used as the aqueous medium but a solvent mixable with water can be also used in combination.

Specific examples of such solvents include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone).

The amount of the aqueous medium is from 50 parts by weight to 2,000 parts by weight and preferably from 100 parts by weight to 1,000 parts by weight based on 100 parts by weight of the toner component.

When the amount of the aqueous medium is too small, the dispersion state of the toner composition is easily degraded, so that toner particles having a desired particle diameter are not obtained.

An amount of the aqueous medium that is excessively large is not preferred in terms of economy.

It is preferable to preliminarily disperse an inorganic dispersant and/or organic resin particulates in an aqueous medium to obtain a toner having a sharp particle size distribution and an excellent dispersion stability.

Specific examples of the inorganic dispersant include, but are not limited to, tricalcium phosphate, calcium carbonate, titanium oxide, colloidal silica and hydroxyapatite.

As a resin to form the organic resin particulates, any resin, for example, a thermoplastic resin and a thermocuring resin, that can form an aqueous dispersion element is suitably usable.

Specific examples thereof include, but are not limited to, vinyl resins, polyurethane resins, epoxy resins, polyester resins, polyamide resins, polyimide resins, silicone resins, phenolic resins, melamine resins, urea resins, aniline resins, ionomer resins, and polycarbonate resins.

These can be used alone or in combination.

Among these resins, vinyl resins, polyurethane resins, epoxy resins, polyester resins, and mixtures thereof are preferably used because an aqueous dispersion element including fine spherical particulates can be easily prepared.

There is no particular limit to the method of the emulsification and dispersion in the aqueous medium.

Known devices employing a low speed shearing method, a high speed shearing method, a friction method, a high pressure jet method, an ultrasonic methods etc., can be used for emulsification and/or dispersion.

Among these, the high speed shearing method is preferable in terms of decreasing the size of the obtained toner particles.

When a high speed shearing type dispersion machine is used, there is no particular limit to the rotation speed thereof.

The rotation speed is typically from 1,000 rpm to 30,000 rpm, and preferably from 5,000 rpm to 20,000 rpm. The temperature during the dispersion process is typically from 0° C. to 150° C. (under pressure) and preferably from 20° C. to 80° C.

When manufacturing the toner from the precursor of the crystalline resin, it is possible to preliminarily mix a hydroxy group or an amine compound required to conduct elongation and/or cross-linking reaction of the precursor of the crystalline resin in the oil phase before dispersing the toner component in the aqueous medium or mix them in the aqueous medium.

In order to remove the organic solvent from the thus prepared emulsion dispersion body, there is no specific limit to the removing method and any known method is suitable. For example, it is possible to employ a method of gradually raising the temperature of the emulsion dispersion body while stirring the system to completely evaporate and remove the organic solvent in the droplets.

When using the agglomeration method in the aqueous medium, it is possible to granulate toner by simultaneous agglomeration by mixing the liquid dispersion such as the resin particulate liquid dispersion obtained by the method described above and the liquid dispersion of the toner component.

The resin particulate liquid dispersion can be used alone or in combination.

The resin particulate liquid dispersion can be added once or in separate occasions.

The same method can be applied to the other liquid dispersions.

To control the agglomeration state, a method of heating, addition of a metal salt, pH adjustment, etc. is preferably used.

There is no specific limit to the metal salt.

Specific examples thereof include, but are not limited to, mono-valent metals forming salts such as sodium and potassium; divalent metals forming salts such as calcium and magnesium; and trivalent metal forming salts such as aluminum.

Specific examples of anions in a salt containing the metal salt include, but are not limited to, chloride ion, bromide ion, iodine ion, carbonate ion, and sulfuric acid ion.

Among these, magnesium chloride, aluminum chloride, and complexes and polymers thereof.

In addition, it is possible to accelerate fusion and adhesion of the resin particulates by heating during or after the agglomeration.

Consequently, uniform toner is obtained.

Furthermore, it is possible to control the form of toner by heating.

As the toner is heated more and more, the toner form becomes closer to a sphere.

Known technologies are used in the process of washing and drying mother toner particles dispersed in the aqueous medium.

That is, after solid and liquid of an aqueous medium are separated by a centrifugal or a filter press to obtain a toner cake, the obtained cake is re-dispersed in de-ionized water at room temperature to about 40° C.

Subsequent to optional pH adjustment by an acid or an alkali, the resultant is subject to the solid and liquid separation treatment again.

This cycle is repeated several times to remove impurities and the active surface agent.

Thereafter, the resultant is dried by an air stream drier, a circulation drier, a reduced pressure drier, a vibration flow drier, etc. to obtain mother toner particles.

It is suitable to remove fine toner particles by a centrifugal, etc.

Optionally, it is also good to obtain a desired particle size distribution by using a known classifier after drying.

It is preferable to fix the surface of the mother toner particles obtained after drying by a method of mixing with a charge control agent or a method of imparting a mechanical impact on the powder mixture.

Consequently, detachment of other particles from the surface of the obtained complex particles is prevented.

Specific examples of such mechanical impact application methods include, but are not limited to, a method in which an impact is applied to a mixture by a blade rotating at a high speed and a method of putting a mixture into a jet air stream to accelerate the speed of (complex) particles to collide each other or with a collision plate.

Specific examples of such mechanical impact applicators (mixer) include, but are not limited to, ONG MILL (manufactured by HOSOKAWA MICRON CO., LTD.), remodeled I TYPE MILL (manufactured by NIPPON PNEUMATIC MFG. CO., LTD.) in which the pressure of pulverization air is reduced, HYBRIDIZATION SYSTEM (manufactured by NARA MACHINE CO., LTD.), KRYPTRON SYSTEM (manufactured by KAWASAKI HEAVY INDUSTRIES, LTD.), automatic mortars, etc.

Charge Control Agent

The colorless transparent toner of the present disclosure may contain a charge control agent.

There is no specific limit to the charge control agent for use in the colorless transparent toner of the present disclosure.

It is preferable to use a no—or little colored material or a material close to white.

Specific examples of the charge control agent include, but are not limited to, triphenylmethane dyes, chelate compounds of molybdic acid, Rhodamine dyes, alkoxyamines, quaternary ammonium salts including fluorine-modified quaternary ammonium salts, alkylamides, phosphor and compounds including phosphor, tungsten and compounds including tungsten, fluorine-containing activators, metal salts of salicylic acid, metal salts of salicylic acid derivatives, etc.

These can be used alone or in combination.

Charge control agents available in the market can be used.

Specific examples thereof include, but are not limited to, BONTRON P-51 (quaternary ammonium salt), E-82 (metal complex of oxynaphthoic acid), E-84 (metal complex of salicylic acid), and E-89 (phenolic condensation product), which are manufactured by ORIENT CHEMICAL INDUSTRIES CO., LTD.; TP-302 and TP-415 (molybdenum complex of quaternary ammonium salt), which are manufactured by HODOGAYA CHEMICAL1 CO., LTD.; COPY CHARGE PSY VP2038 (quaternary ammonium salt), COPY BLUE PR (triphenyl methane derivative), COPY CHARGE NEG VP2036 and NX VP434 (quaternary ammonium salt), which are manufactured by HOECHST AG; LRA-901, and LR-147 (boron complex), which are manufactured by JAPAN CARLIT CO., LTD.; quinacridone, azo pigments and polymers having a functional group such as a sulfonate group, a carboxyl group, and a quaternary ammonium group.

The charge control agent can be dissolved or dispersed in an organic solvent after the charge control agent is kneaded together with a master batch pigment and resin.

In addition, the charge control agent can be directly dissolved or dispersed in an organic solvent when the toner component is dissolved or dispersed in an organic solvent.

Alternatively, the charge control agent may be fixed on the surface of the toner particles after the toner particles are prepared.

The content of the charge control agent depends on the kind of the binder resin, the presence of additives, and the dispersion method but is preferably from 0.1 parts by weight to 10 parts by weight and more preferably from 0.2 parts by weight to 5 parts by weight based on 100 parts by weight of the binder resin.

When the content is too small, the charge control property may not demonstrate.

When the content is too high, the toner tends to have an excessively large size of charge, which reduces the effect of the charge control agent.

Therefore, the electrostatic attraction force between a developing roller and the toner increases, resulting in deterioration of the fluidity of the development agent and a decrease in the image density.

Coloring Agent

The colorless transparent toner of the present disclosure can be used in combination with a color toner having a the coloring agent as a set of color toner.

Suitable coloring agents (coloring material) for use in the color toner include known dyes and pigments.

Specific examples thereof include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like.

These materials can be used alone or in combination.

These can be used alone or in combination.

Specific examples of the black pigments include, but are not limited to, carbon black (C.I. Pigment Black 7) such as furnace black, lamp black, acetylene black, and channel black, metals such as copper, iron (C.I. Pigment Black 11), and titanium oxides, and organic pigments such as aniline black (C.I. Pigment Black 1).

Specific examples of the pigments for magenta include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; C.I. Vat Red 1, 2, 10, 13, 15, 23, 29, and 35.

Specific examples of the pigments for cyan include, but are not limited to, C.I. Pigment Blue 2, 3, 15, 15:1, 15:2, 15:3, 15:4, 15:6, 16, 17, 60; C.I. Vat Blue 6; C.I. Acid Blue 45; Copper phthalocyanine pigments in which one to five phthal imidemethyl groups are substituted in the phthalocyanine skeleton; and Green 7 and Green 36.

Specific examples of the pigments for yellow include, but are not limited to, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180; C.I. Vat Yellow 1, 3, and 20; and Orange 36.

There is no specific limit to the content of the coloring agent in the toner but it is preferably from 1% by weight to 15% by weight and more preferably from 3% by weight to 10% by weight. When the content of the coloring agent is too small, the coloring ability of the toner may deteriorate.

To the contrary, when the content of the coloring agent is too large, poor dispersion of the pigment tends to occur in the toner, thereby degrading the coloring ability and the electric characteristics of the toner.

The coloring agent and the resin can be used in combination as a master batch. There is no specific limit to the resin.

Specific examples thereof include, but are not limited to, styrene or substituted polymers thereof, styrene-based copolymers, polymethyl methacrylate resins, polybutyl methacrylate resins, polyvinyl chloride resins, polyvinyl acetate resins, polyethylene resins, polypropylene resins, polyesters resins, epoxy resins, epoxy polyol resins, polyurethane resins, polyamide resins, polyvinyl butyral resins, polyacrylic resins, rosin, modified rosins, terpene resins, aliphatic hydrocarbon resins, alicyclic hydrocarbon resins, aromatic petroleum resins, chlorinated paraffin, and paraffin.

These can be used alone or in combination.

Specific examples of styrene-based copolymers or substituted polymers of styrene include, but are not limited to, polyester resins, polystyrene resins, poly(p-chlorostyrene) resins, and polyvinyl toluene resins. Specific examples of the styrene-based copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers.

These resins for the master batch may be the crystalline resins described above of the present disclosure.

The master batch is prepared by mixing and kneading the resin for the master batch resin mentioned above and the coloring agent mentioned above upon application of high shear stress thereto.

In this case, an organic solvent can be used to boost the interaction between the coloring agent and the resin.

In addition, so-called flushing methods are advantageous in that there is no need to drying because a wet cake of the coloring agent can be used as it is.

The flushing method is a method in which a water paste containing water of a coloring agent is mixed or kneaded with an organic solvent and the coloring agent is transferred to the resin side to remove water and the organic solvent component.

High shearing dispersion devices such as a three-roll mill, etc. can be preferably used for mixing or kneading.

Releasing Agent

The colorless transparent toner of the present disclosure may contain a releasing agent to improve the releasing property.

There is no specific limit to the releasing agent.

Specific examples thereof include, but are not limited to, waxes having a carbonyl group, polyolefin waxes, and long-chain hydrocarbons.

These can be used alone or in combination.

Among these waxes, waxes including a carbonyl group are p preferable.

Specific examples of the waxes including a carbonyl group include, but are not limited to, polyalkane acid ester, polyalkanol ester, polyalkane acid amide, ppolyalkyl amide, and dialkyl ketone.

Specific examples of the polyalkanol esters include, but are not limited to, carnauba wax, montan waxes, trimethylolpropane tribehenate, pentaerythritol tetrabehenate, pentaerythritol diacetate dibehenate, glycerin tribehenate, and 1,18-octadecane diol distearate. Specific examples of the polyalkanol esters include, but are not limited to, trimellitic acid tristearyl and distearyl maleate.

A specific example of the polyalkane acid amide is dibehenyl amide.

A specific example of the polyalkyl amide is trimellitic acid tristearyl amide.

A specific example of the dialkyl ketone is distearyl ketone.

Among these waxes including a carbonyl group, the polyalkane acid esters are preferably usable.

Specific examples of the polyolefin waxes include, but are not limited to, polyethylene waxes, and polypropylene waxes.

Specific examples of the waxes such as the long chain hydrocarbons include, but are not limited to, paraffin wax, and sazol wax.

There is no specific limit to the melting point of the releasing agent.

It is preferably from 40° C. to 160° C., more preferably from 50° C. to 120° C., and particularly preferably from 60° C. to 90° C. When the melting point of the releasing agent is too low, the high temperature stability of the toner tends to deteriorate.

When the melting point is too high, cold offset may occur during the fixing process.

The melting point of the releasing agent can be measured by a differential scanning calorimeter (for example, DSC210, manufactured by SEIKO ELECTRONICS INDUSTRIAL CO., LTD.).

A specific example of the measuring methods is: raise the temperature of the sample to 200° C.; thereafter cool it down from 200° C. to 0° C. at a temperature dropping speed of 10° C./min.; Raise the obtained sample at a temperature rising speed of 10° C./min.; and determine the maximum peak temperature of the melting heat.

The releasing agent preferably has a melt viscosity of from 5 cps to 1,000 cps and more preferably from 10 cps to 100 cps at a temperature 20° C. higher than the melting point of the releasing agent.

When the melt viscosity of the releasing agent is too low, the releasability of the toner tends to deteriorate.

When the melt viscosity is too high, the hot offset resistance and the low temperature fixability of the toner may deteriorate.

When the releasing agent is contained, the content of the releasing agent is preferably from 0% by weight to 40% by weight and more preferably from 3% by weight to 30% by weight.

When the content of the releasing agent is too large, the fluidity of the toner may deteriorate.

External Additive

The colorless transparent toner of the present disclosure may contain an external additive to improve the fluidity, the developability, the chargeability, etc.

There is no specific limit to the external additive.

Specific examples thereof include, but are not limited to, silica particulates, hydrophobized silica particulates, aliphatic acid metal salts (e.g., zinc stearate, aluminum stearate); metal oxides (e.g., titanium oxide, alumina, tin oxide, and anthimony oxide); hydrophobized metal oxide particulates; and fluoropolymers.

Among these, hydrorphobized silica particulates, hydrophobized titanium oxide particulates, and hydrophobized alumina particulates are preferable.

Specific examples of the silica particulates include, but are not limited to, HDK H 2000, HDK H 2000/4, HDK H 2050 EP, HVK21, HDK H 1303, (all manufactured by HOECHST AG), R972, R974, RX200, RY200, R202, R805, and R812 (manufactured by NIPPON AEROSIL CO., LTD.)

Specific examples of the titan oxide particulates include, but are In addition, specific examples of the titan oxide particulates include, but are not limited to, P-25 (manufactured by NIPPON AEROSIL CO., LTD.), SIT-30 and STT-65C-S (manufactured by TITAN KOGYO, LTD.), TAF-140 (manufactured by FUJI TITANIUM INDUSTRY CO., LTD.), and MT-150W, MT-500B, MT-600B, and MT-150A (manufactured by TAYCA CORPORATION).

Specific examples of the hydrophobized titan oxide particulates include, but are not limited to, T-805 (manufactured by NIPPON AEROSIL CO., LTD.); STT-30A and SU-655-S (manufactured by TITAN KOGYO, LTD.); TAF-500T and TAF-1500T (manufactured by FUJI TITANIUM INDUSTRY CO., LTD.); MT-100S and MT-100T (manufactured by TAYCA CORPORATION); and IT-S (manufactured by ISHIHARA SANGYO KAISHA LTD.).

The hydrophobized silica particulates, the hydrophobized titan oxide particulates, and the hydrophobized alumina particulates can be obtained by treating hydrophillic particulates such as silica particulates, titanium oxide particulates, and alumina particulates with a silane coupling agent such as methyl trimethoxyxilane, methyltriethoxy silane, and octyl trimethoxysilane.

It is preferable to use silicone oil as an external additive.

In addition, it is also preferable to use silicon oil treated inorganic particulates formed by treating inorganic particulates by heated silicone oil.

Specific examples of the silicone oils include, but are not limited to, dimethyl silicone oil, methylphenyl silicone oil, chlorophenyl silicone oil, methylhydrogene silicone oil, alkyl-modified silicone oil, fluorine-modified silicone oil, polyether-modified silicone oil, alcohol-modified silicone oil, amino-modified silicone oil, epoxy-modified silicone oil, epoxy/polyether silicone oil, phenol-modified silicone oil, carboxyl-modified silicone oil, mercapto-modified silicone oil, (meth)acryl-modified silicone oil, and α-methylstyrene-modified silicone oil.

Specific examples of such inorganic particulates treated by silicon oil include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Among these, silica and titanium dioxide are preferable.

The addition amount of the external additive is preferably from 0.1% by weight to 5% by weight and more preferably from 0.3% by weight to 3% by weight based on the toner.

The primary particles of the inorganic particulate preferably have a number average particle diameter of 100 nm or less and more preferably from 3 nm to 70 nm.

When the number average particle diameter is too small, the inorganic particulates tend to be buried in the toner, thereby preventing the inorganic particulates from exhibiting their features.

When the number average particle diameter is too large, the surface of the latent electrostatic image bearing member is non-uniformly damaged when forming an image on the latent electrostatic image bearing member with toner.

It is possible to use inorganic particulates and hydrophobized inorganic particulates in combination as an external additive.

However, the number average particle diameter of the hydrophobized primary particles preferably ranges from 1 nm to 100 nm and it is more preferable to contain at least two kinds of inorganic particulates of from 5 nm to 70 nm.

Furthermore, the external additives preferably contain at least two kinds of inorganic particulates having hydrophobized primary particles having a number average primary particle diameter of 20 nm or less and at least one kind of inorganic particulates having hydrophobized primary particles having a number average primary particle diameter of 30 nm or greater.

In addition, the specific surface area of the external additive as measured by the BET method is preferably from 20 $m^2/g$ to 500 $m^2/g$.

Specific examples of surface treating agents of the external additives containing oxide particulates include, but are not limited to, silane coupling agents such as dialkyl dihalogenated silane, trialkyl halogenized silane, alkyl trihalogenized silane, and hexa alkyl disilazane; silylating agents, silane coupling agents having an alkyl fluoride group, organic titanate coupling agents, aluminum-containing coupling agents, silicone oil, and silicone varnish.

Resin particulates can be used as an external additive for the toner of the present disclosure.

Specific examples of the resin particulates include, but are not limited to, polystyrene prepared by a soap-free emulsion polymerization method, a suspension polymerization method, or a dispersion polymerization method; and copolymers of methacrylic acid esters and acrylic acid esters; polycondensation resins such as silicone resins, benzoguanamine resins, and nylon resins, and polymerized particles by a thermocuring resin.

By a combinational use of such resin particulates, the chargeability of the toner is improved, thereby reducing the reversely charged toner, resulting in a decrease of background fouling.

The addition amount of the resin particulates is preferably from 0.01% by weight to 5% by weight and more preferably from 0.1% by weight to 2% by weight based on the toner.

Development Agent

The toner of the present disclosure can be used as a single-component development agent and a two-component development agent.

Using the toner in the two-component development agent is preferable in terms of the length of the working life, etc.

When the toner of the present disclosure is used in a two-component development agent, the two-component development agent contains other components such as magnetic carrier.

When the toner of the present disclosure is used in a single-component development agent, the particle diameter of the toner varies little even when the toner is consumed by development and is replenished for compensation.

In addition, filming of the toner to a developing roller and fusion and attachment of a toner to a layer regulating member such as a blade to slim the layer of the toner tend to decrease. Furthermore, while the development device is used (stirring) for an extended period of time, the development and the obtained imaged are good and stable.

In a case of a two-component development agent using the toner of the present disclosure is used, even when the toner is replenished and consumed for an extended period of time, the particle diameter of the toner in the development agent varies little.

In addition, good and stable developability is sustained even when the development agent is stirred in the development device for an extended period of time.

There is no specific limit to the carrier.

Carrier is preferable which contains a core material and a resin layer that covers the core material.

There is no specific limit to the material for the core material.

For example, manganese-strontium (Mn—Sr) based materials and manganese-magnesium (Mn—Mg) based materials having 50 emu/g to 90 emu/g are preferable.

To secure the image density, highly magnetized materials such as iron powder having 100 emu/g or more and magnetite having 75 emu/g to 120 emu/g are preferable. In addition, weakly magnetized copper-zinc (Cu—Zn) based materials having 30 emu/g to 80 emu/g are preferable in terms of reducing the impact of the contact between the toner filaments formed on the development roller and the image bearing member, which is advantageous in improvement of the image quality.

These can be used alone or in combination.

The weight average particle diameter of the core material is preferably from 10 μm to 200 μm and more preferably from 40 μm to 100 μm.

When the particle diameter of the core material is too small, the ratio of fine powder is small in the distribution of the carrier particle and magnetization per particle tends to decrease, which causes carrier scattering.

On the other hand, when the particle diameter of the core material is too large, the specific surface area tends to lower, which leads to toner scattering.

In particular, the reproducibility of the solid portion tends to worsen when printing an image with many solid portions in full color.

There is no specific limit to the materials for the resin layer co cover the core material.

Specific examples thereof include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexa fluoropropylene resins, copolymers of vinylidene fluoride resins and acrylic monomers, copolymers of vinyl fluoride and vinylidene fluoride, fluoro terpolymers such as copolymers of tetra fluoroethylene, vinylidene fluoride and monomers including no fluorine atom, and silicone resins.

These can be used alone or in combination.

Among the materials for the resin layer, silicone resins are preferable.

There is no specific limit to the silicone resins.

Specific examples thereof include, but are not limited to, straight silicone resins formed of only organosiloxane bond; and silicone resins modified by alkyd resins, polyester resins, epoxy resins, acrylic resins, urethane resins, etc.

Products of silicone resins available in the market can be used.

Specific examples of the straight silicone resin include, but are not limited to, KR271, KR255, and KR152, manufactured by Shin-Etsu Chemical Co., Ltd.; and SR2400, SR2406, and SR2410, manufactured by DOW CORNING TORAY CO., LTD.

Products of modified silicone resins available in the market can be used.

Specific examples thereof include, but are not limited to, KR206 (alkyd-modified), KR5208 (acrylic-modified), ES1001N (epoxy-modified), and KR305 (urethane-modified) manufactured by Shin-Etsu Chemical Co., Ltd.; and SR2115 (epoxy-modified), and SR2110 (alkyd-modified), manufactured by DOW CORNING TORAY CO., LTD.

The silicone resin can be used alone and in combination with a cross-linking reaction component and a charge size adjusting component.

The resin layer may contain electroconductive powder such as metal powder, carbon black, titanium oxide, tin oxide, and zinc oxide.

The average particle diameter of such electroconductive powder is preferably 1 μm or greater.

When the average particle diameter is too large, controlling the electric resistance may become difficult.

There is no specific limit to method of forming the resin layer.

The resin layer described above can be formed by, for example, dissolving the silicone resin described above, etc. in a solvent to prepare a liquid application and applying the liquid application to the surface of the core material described above by a known application method followed by drying and baking.

Specific examples of the known application methods include, but are not limited to, a dip coating method, a spray coating method, and a brushing method.

There is no specific limit to the solvent to dissolve the silicone resin.

Specific examples thereof include, but are not limited to, toluene, xylene, methylethyl ketone, methylisobutyl ketone, cellosolve, and butylacetate.

There is no specific limit to the baking.

An external heating system or an internal heating system can be used.

For example, a fixed electric furnace, a fluid electric furnace, a rotary electric furnace, a method of using a burner furnace, and a method of using a microwave can be suitably used.

The content of the resin layer in the carrier is preferably from 0.01% by weight to 5.0% by weight.

When the content of the resin layer in the carrier is too small, a uniform resin layer may not be formed on the surface of the core material.

When the content of the resin layer in the carrier is too large, the resin layer becomes too thick to form uniform carrier particles because of granulation of the carrier particles.

There is no specific limit to the content of the carrier in the two-component development agent. It is preferably from 90% by weight to 98% by weight and more preferably from 93% by weight to 97% by weight.

The mixing ratio of the toner to the carrier in the two component development agent is preferably 1 part by weight to 10 parts by weight based on 100 parts by weight of the carrier.

Image Forming Apparatus

The image forming apparatus of the present disclosure is briefly described.

There is no specific limit to the image forming apparatus of the present disclosure if it includes a latent image bearing member, a charger to charge the latent image bearing member, an irradiator to irradiate the charged latent image bearing member with light to from a latent electrostatic image, a development device to develop the latent image bearing member formed on the latent electrostatic image with the colorless transparent toner of the present disclosure to form a toner image, and a transfer device to transfer the toner image formed on the latent electrostatic image to a recording medium.

An example of the method of forming images using the image forming apparatus is briefly described but the present disclosure is not limited thereto.

The image forming apparatus has a drum-like photoreceptor (latent image bearing member) and is rotatably driven, for example, counterclockwise.

After a discharging lamp discharges the surface of the photoreceptor, the charger charges the surface of the photoreceptor.

Next, the irradiator irradiates the surface of the photoreceptor to from a latent electrostatic image.

Thereafter, the development device develops the latent electrostatic image with the colorless transparent toner of the present disclosure to form a toner image.

Furthermore, after a pre-transfer charger charges the toner image formed on the surface of the photoreceptor, a transfer charger transfers the toner image to a recording sheet fed from a registration roller.

Then, a separation charger charges the recording sheet to which the toner image has been transferred and thereafter a separating claw separates the recording sheet from the photoreceptor.

A pre-cleaning charger charges the toner remaining on the surface of the photoreceptor and thereafter a cleaning brush, a cleaning blade, etc. removes the toner.

EXAMPLES

Next, the present disclosure is described in detail with reference to Examples but not limited thereto.

Manufacturing of Crystalline Resin

The acid components, the alcohol components, the isocyanate components, and their mixture amount of the crystalline resin for use in Examples and Comparative Examples are shown in Table 1.

TABLE 1

| | Acid component | | Alcohol component | | Isocyanate component | |
|---|---|---|---|---|---|---|
| | Sebacic acid | Adipic acid | 1,6-hexane diol | 1,4-butane diol | Hexamethylene diisocyanate | 4,4'-diphenyl methane diisocyanate |
| Crystalline Resin 1 | 280 | 30 | 210 | 0 | 7 | 0 |
| Crystalline Resin 2 | 150 | 30 | 100 | 85 | 9 | 0 |

TABLE 1-continued

| | Acid component | | Alcohol component | | Isocyanate component | |
|---|---|---|---|---|---|---|
| | Sebacic acid | Adipic acid | 1,6-hexane diol | 1,4-butane diol | Hexamethylene diisocyanate | 4,4'-diphenyl methane diisocyanate |
| Crystalline Resin 3 | 250 | 30 | 0 | 220 | 8 | 0 |
| Crystalline Resin 4 | 280 | 30 | 0 | 200 | 0 | 7 |
| Crystalline Resin 5 | 200 | 30 | 100 | 100 | 0 | 8 |
| Crystalline Resin 6 | 220 | 30 | 180 | 50 | 0 | 8 |
| Crystalline Resin 7 | 250 | 30 | 200 | 0 | 0 | 0 |

Place the acid component, the alcohol component, and 1 part of titanium dihydroxybis(triethanol aminate) as a condensing catalyst in a reaction container equipped with a condenser, a stirrer, and a nitrogen introducing tube to conduct reaction at 180° C. for eight hours in a nitrogen atmosphere while distilling away produced water.

Next, gradually heat the system to 225° C. to conduct reaction for four hours in a nitrogen atmosphere while distilling away produced water and alcohol and continue the reaction with a reduced pressure of from 5 mmHg to 20 mmHg Transfer 200 parts of the thus-obtained crystalline resin to another reaction container equipped with a condenser, a stirrer, and a nitrogen introducing tube and add 250 parts of ethyl acetate and the isocyanate shown in Table 1 thereto to conduct reaction at 80° C. in a nitrogen atmosphere for five hours.

Thereafter, obtain Crystalline Resin 1-7 by distilling away ethyl acetate under a reduced pressure.

Manufacturing of Crystalline Resin Precursor

Place 25 parts of hexamethylene diisocyanate (HDI) and 250 parts of ethyl acetate in a reaction container equipped with a condenser, a stirrer, and a nitrogen introducing tube.

Furthermore, add a resin solution in which 250 parts of Crystalline Resin 1 are dissolved in 250 parts of ethyl acetate to conduct reaction at 80° C. for five hours in a nitrogen atmosphere.

By this reaction, 50% by weight ethyl acetate solution having an isocyanate group (Crystalline Resin Precursor 1) at its end is obtained.

Crystalline Resin Precursor 2 and Crystalline Resin Precursor 3 are obtained in the same manner as in manufacturing Crystalline Resin Precursor 1 except that Crystalline Resin 1 is changed to Crystalline Resin 2 and Crystalline Resin 3, respectively.

Manufacturing of Non-Crystalline Resin

Place 230 parts of an adduct of bisphenol A with 2 mols of ethylene oxide, 100 parts of an adduct of bisphenol A with 2 mols of propylene oxide, 165 parts of isophthalic acid, and 1.0 part of tetrabuthoxy titanate in a reaction container equipped with a condenser, a stirrer, and a nitrogen introducing tube to conduct reaction at 230° C. for eight hours in a nitrogen atmosphere while distilling away produced water.

Thereafter, further conduct reaction under a reduced pressure of from 5 mmHg to 20 mmHg. Cool down to 180° C. when the acid value is 2, add 35 parts to trimellitic anhydride, and conduct reaction at normal pressure for three hours to obtain Non-Crystalline Resin 1. The obtained Non-Crystalline Resin 1 has an Mw of 7,500 and a Tg of 61° C.

Manufacturing of Non-Crystalline Resin Precursor

Place 800 parts of an adduct of bisphenol A with 2 mols of ethylene oxide, 120 parts of an adduct of bisphenol A with 2 mols of propylene oxide, 280 parts of terephthalic acid, and 1 part of tetrabuthoxy titanate in a reaction container equipped with a condenser, a stirrer, and a nitrogen introducing tube to conduct reaction at 230° C. for eight hours in a nitrogen atmosphere while distilling away produced water.

Thereafter, further conduct reaction for seven more hours under a reduced pressure of from 10 to 15 mmHg to obtain a non-crystalline resin precursor intermediate.

Next, place 400 parts of the thus-obtained non-crystalline resin precursor intermediate, 105 parts of isophorone diisocyanate, and 500 parts of ethyl acetate in a reaction container equipped with a condenser, a stirrer, and a nitrogen introducing tube to conduct reaction at 80° C. in a nitrogen atmosphere for eight hours to obtain a 50% by weight ethyl acetate solution of Non-Crystalline Resin Precursor 1 having an isocyanate group at its end.

Manufacturing of Coloring Agent Master Batch

Superimpose the colorless transparent toner of the present disclosure on a solid image formed by a color toner containing a coloring agent to obtain a superimposed solid image followed by fixing to provide a sufficient attachment force to substrate.

The method of manufacturing a coloring agent master batch for color toner is described below.

Mix 100 parts of the Crystalline Resin 1, 100 parts of each the following pigments, and 30 parts of deionized water followed by mixing and kneading in an open roll type mixing and kneading machine (KNEADEX, manufactured by NIPPON COKE & ENGINEERING CO., LTD.).

Start the mixing and the kneading at 90° C. and cool the mixture down gradually to 50° C.

Consequently, Coloring Agent Master Batch C1, Coloring Agent Master Batch M1, Coloring Agent Master Batch Y1, and Coloring Agent Master Batch K1 having a mass ratio of resin to pigment of 1:1 are obtained.

The used pigments are: cyan pigment (C.I. Pigment blue 15:3); magenta pigment (C.I. Pigment red 122); yellow pigment (C.I. Pigment yellow 180); and black pigment (carbon black).

In addition, Coloring Agent Master Batch C2, Coloring Agent Master Batch M2, Coloring Agent Master Batch Y2, and Coloring Agent Master Batch K2 are obtained in the same manner except that Crystalline Resin 1 is changed to Crystalline Resin 2.

In addition, Coloring Agent Master Batch C3, Coloring Agent Master Batch M3, Coloring Agent Master Batch Y3, and Coloring Agent Master Batch K3 are obtained in the same manner except that Crystalline Resin 1 is changed to Non-Crystalline Resin 1.

In addition, Coloring Agent Master Batch C4, Coloring Agent Master Batch M4, Coloring Agent Master Batch Y4, and Coloring Agent Master Batch K4 are obtained in the same manner except that Crystalline Resin 1 is changed to Crystalline Resin 7.

Manufacturing of Organic-Modified Laminar Inorganic Mineral Master Batch

Mix 100 parts of Crystalline Resin 1, 100 parts of a montmorillonite compound (CLAYTONE APA, manufactured by SOUTHERN CLAY PRODUCTS INCORPORATED) modified by quaternary ammonium at least partially having a benzyl group, and 50 parts of deionized water followed by mixing and kneading by an open roll mixing kneader.

Start the mixing and the kneading at 90° C. and cool the mixture down gradually to 50° C.

Consequently, Organic-modified Laminate Inorganic Mineral Master Batch 1 having a mass ratio of resin to pigment of 1:1 are obtained.

Organic-modified Laminate Inorganic Mineral Master Batch 2 and Organic-modified Laminate Inorganic Mineral Master Batch 3 are obtained in the same manner except that the montmorillonite compound is changed to CLAYTONE HY and LUCENTITE SPN, respectively.

In addition, Organic-modified Laminate Inorganic Mineral Master Batch 4 is obtained in the same manner except that Crystalline Resin 1 is changed to Non-Crystalline Resin 1.

In addition, Organic-modified Laminate Inorganic Mineral Master Batch 5 is obtained in the same manner except that Crystalline Resin 1 is changed to Crystalline Resin 7.

Manufacturing of Wax (Releasing Agent) Liquid Dispersion

Place 20 parts of paraffin wax (HNP-9, melting point: 75° C., manufactured by NIPPON SEIRO CO., LTD.) and 80 parts of ethyl acetate in a reaction container equipped with a condenser, a thermometer, and a stirrer, heat the system to 78° C. to dissolve the wax; and cool it down to 30° C. in one hour while stirring.

Thereafter, wet-pulverize the resultant under the conditions of: liquid transfer speed 1.0 kg/h; disk circumferential speed: 10 m/s; filling amount of 0.5 mm zirconia beads: 80% by volume; number of passes: 6 to obtain wax liquid dispersion.

Manufacturing of Toner

Synthesis of Resin Liquid Dispersion (Organic Particulate Emulsion)

Place the following recipe in a container equipped with a stirrer and a thermometer and stir at 4,200 rpm for 1 hour to obtain white emulsion.

Deionized water: 680 parts

Sodium salt of sulfate of an adduct of methacrylic acid with ethyleneoxide (EREMINOR RS-30, manufactured by SANYO CHEMICAL INDUSTRIES, LTD.): 13 parts Styrene: 80 parts Methacrylic acid: 80 parts Butyl acrylate: 105 parts Ammonium persulfate: 2 parts Heat the system temperature to 75° C. to conduct reaction for four hours.

Furthermore, add 30 parts of an aqueous solution of 1% by weight ammonium persulfate and age the system for six hours at 75° C. to obtain Resin Liquid Dispersion 1.

Measure the volume average particle diameter of the obtained Resin Liquid Dispersion 1 by a laser diffraction/scattering type particle size distribution analyzer (LA-920, manufactured by HORIBA LTD.).

The Resin Liquid Dispersion 1 has a volume average particle diameter of 50 nm. In addition, dry and separate part of the Resin Liquid Dispersion 1.

The resin portion has a glass transition temperature (Tg) of 52° C. and a weight average molecular weight (Mw) of 120,000.

Preparation of Aqueous Phase

Uniformly dissolve 200 parts of Resin Liquid Dispersion 1 and 70 parts of non-ionic surface active agent (DSK-NL-450, manufactured by Dai-Ichi Kogyo Seiyaku Co., Ltd.) in 800 parts of deionized water by mixing and stirring to obtain Aqueous Phase 1.

Manufacturing Example

The kinds and the amount of the resins (crystalline resin, non-crystalline resin, crystalline resin precursor, or non-crystalline resin precursor) and organic-modified laminar mineral master batch are shown in Table 2. In addition, manufacture color toner containing a master batch containing a coloring agent other than the colorless transparent toner.

The color toner is manufactured in the same manner as in that of the colorless transparent toner except that the coloring agent master batch is mixed.

TABLE 2

| | Kind of crystalline resin | Parts by weight | Kind of non-crystalline resin | Parts by weight | Kind of crystalline resin precursor | Parts by weight |
|---|---|---|---|---|---|---|
| Toner Set 1 | Crystalline Resin 1 | 80 | — | — | Precursor 1 | 25 |
| Toner Set 2 | Crystalline Resin 2 | 80 | — | — | Precursor 1 | 25 |
| Toner Set 3 | Crystalline Resin 3 | 80 | — | — | Precursor 1 | 25 |
| Toner Set 4 | Crystalline Resin 4 | 90 | — | — | Precursor 2 | 30 |
| Toner Set 5 | Crystalline Resin 5 | 85 | — | — | Precursor 2 | 30 |
| Toner Set 6 | Crystalline Resin 6 | 90 | — | — | Precursor 2 | 30 |
| Toner Set 7 | Crystalline Resin 1 | 75 | — | — | Precursor 3 | 25 |
| Toner Set 8 | Crystalline Resin 2 | 75 | — | — | Precursor 3 | 40 |

TABLE 2-continued

| | | | | | | |
|---|---|---|---|---|---|---|
| Toner Set 9 | Crystalline Resin 3 | 90 | — | — | — | — |
| Toner Set 10 | — | — | Non-Crystalline Resin 1 | 80 | — | — |
| Toner Set 11 | — | — | Non-Crystalline Resin 1 | 70 | — | — |
| Toner Set 12 | — | — | Non-Crystalline Resin 1 | 80 | — | — |
| Toner Set 13 | Crystalline Resin 7 | 130 | — | — | | |

| | Kind of non-crystalline resin precursor | Parts by weight | Kind of organic-modified laminar inorganic mineral master batch | Parts by weight | Kind of coloring agent master batch when using coloring agent | Parts by weight |
|---|---|---|---|---|---|---|
| Toner Set 1 | — | — | Master Batch 1 | 2 | C1, M1, Y1, K1, | 12 |
| Toner Set 2 | — | — | Master Batch 1 | 2 | C1, M1, Y1, K1, | 12 |
| Toner Set 3 | — | — | Master Batch 1 | 2 | C1, M1, Y1, K1, | 12 |
| Toner Set 4 | — | — | Master Batch 2 | 2 | C1, M1, Y1, K1, | 12 |
| Toner Set 5 | — | — | Master Batch 2 | 2 | C1, M1, Y1, K1, | 12 |
| Toner Set 6 | — | — | Master Batch 2 | 2 | C2, M2, Y2, K2, | 12 |
| Toner Set 7 | — | — | — | — | C2, M2, Y2, K2, | 12 |
| Toner Set 8 | — | — | Master Batch 3 | 2 | C2, M2, Y2, K2, | 12 |
| Toner Set 9 | — | — | Master Batch 3 | 2 | C2, M2, Y2, K2, | 12 |
| Toner Set 10 | — | — | Master Batch 4 | 2 | C3, M3, Y3, K3, | 12 |
| Toner Set 11 | Precursor 1 | 25 | Master Batch 4 | 2 | C3, M3, Y3, K3, | 12 |
| Toner Set 12 | Precursor 1 | 15 | | | C3, M3, Y3, K3, | 12 |
| Toner Set 13 | — | — | Master Batch 5 | 2 | C3, M3, Y3, K3, | 12 |

Add a resin (e.g., Crystalline Resin 1-7 or Non-crystalline Resin 1) shown in Table 2 in a reaction container equipped with a thermometer and a stirrer in an amount of the number in parts by weight shown in Table 2.

Next, add 80 parts of ethyl acetate to dissolve the resin at a temperature equal to or higher than the melting point of the resin.

Thereafter, add 20 parts by weight of Wax Liquid Dispersion and Laminar Inorganic Mineral Master Batch 1 to 5 in an amount of the number in parts by weight shown in Table 2.

In addition, when manufacturing coloring toner, add one of the Coloring Agent Master Batch C1 to K1 to the Coloring Agent Master Batch C4 to K4 in an amount of the number in parts by weight shown in Table 2.

When manufacturing colorless transparent toner, add no Coloring Agent Master Batch.

Furthermore, add 2 parts of ethyl acetate thereto and uniformly dissolve and disperse using a TK type HOMOMIXER (manufactured by TOKUSHU KIKA KOGYO CO., LTD.) at 10,000 rpm at 50° C. by stirring to obtain an oil phase.

Keep the temperature of the oil phase at 50° C. in the container and use the oil phase within five hours of manufacturing to prevent crystallization.

The thus-obtained Oil Phase 1 to 13 obtained in Examples and Comparative Examples correspond to materials of Toner Set 1 to 13 shown in Table 2.

Next, place 100 parts of Aqueous Phase 1 heated to 50° C. in another reaction container equipped with a stirrer and a thermometer.

Mix 100 parts of Oil Phase 1 to 13 kept at 50° C. with a resin precursor (e.g., Crystalline Resin Precursor 1 to 3 or Non-Crystalline Resin 1) in an amount of the number in parts by weight shown in Table 2 and add the obtained mixture to Aqueous Phase 1.

Thereafter, mix them by a TK HOMOMIXER (manufactured by TOKSHU KIKA KOGYO CO., LTD.) in a temperature range of from 40° C. to 50° C. at 13,000 rpm for one minute to obtain Emulsified Slurry 1 to 13.

Place each of Emulsified Slurry 1 to 13 in a reaction container equipped with a stirrer and a thermometer followed by removal of the solvent at 50° C. for eight hours.

Subsequent to a five hour aging at 45° C., Slurry Dispersion 1 to 13 are obtained.

Filtrate 100 parts of each of the thus-obtained Slurry Dispersion 1 to 13 with a reduced pressure followed by the following washing treatment:

Add 100 parts of deionized water to each of Slurry Dispersion 1 to 13 (filtered cake) and mix the resultant by a TK HOMOMIXER at 6,000 rpm for five minutes followed by filtration;

Add 100 parts of 10% sodium hydroxide aqueous solution to the obtained filtered cake and mix the resultant by a TK HOMOMIXER at 6,000 rpm for ten minutes followed by filtration with a reduced pressure; Add 100 parts of 10% by weight hydrochloric acid to the filtered cake and mix the resultant by a TK HOMOMIXER at 6,000 rpm for five minutes followed by filtration;

Then, add 300 parts of deionized water to the obtained filtered cake and mix the resultant by a TK HOMOMIXER at 6,000 rpm for five minutes followed by filtration.

This process is repeated twice to obtain Filtered Cakes 1 to 13.

Dry Filtered Cake 1 to 13 by a circulating drier at 45° C. for 48 hours.

Screen the dried cakes using a screen having an opening of 75 μm to obtain Mother Toner 1 to 13.

Mix 100 parts of each of the thus-obtained Mother Toner 1 to 13 with 1.0 part of hydrophobic silica (HDK-2000, manufactured by WACKER-CHEMIE GMBH) by using a HENSCHEL MIXER to obtain Colorless Transparent Toner 1 to 13 (Color Toner 1 to 13, when the coloring agent is added).

Colorless Transparent Toner 1 to 13 and their corresponding numbered Color Toner 1 to 13 make Toner Set 1 to 13t.

With regard to Colorless Transparent Toner 1 to 13, the following is obtained by the method described above:

(I): The ratio {C/(C+A)}, where C represents the integration intensity of the spectrum deriving from the crystalline structure and A represents the integration intensity of the spectrum deriving from the non-crystalline structure;

(II): The maximum endothermic peak temperature T1 (° C.) and the exothermic peak temperature T2 (° C.) for the second time of temperature rising and for the first time descending, respectively, as measured by the differential scanning calorimeter (DSC) during the temperatures rising and descending in the range of from 0° C. to 100° C. at a temperature rising and descending speed of 10° C./min;

(III): The ratio of the molecular weight of 100,000 or more and the weight average molecular weight as measured by gel diffusion chromatography of tetrahydrofuran soluble portion; and (IV): The endothermic amount (ΔH(T))(J/g) as measured by a differential scanning calorimeter (DSC), the ratio (ΔH(H)(J/g) and (ΔH(H)/ΔH(T) of the insoluble portion in a liquid mixture of ethyl acetate and tetrahydrofuran (THF) having a mixing ratio of 1:1 as measured by the differential scanning calorimeter DSC.

The obtained characteristics are shown in Table 3.

TABLE 3

| | Ratio C/(C + A) | Maximum endo-thermic peak T1 | Maximum exo-thermic peak T2 | T2 − T1 | Weight average molecular weight | Rate (%) of molecules having molecular weight of 100,000 or more | ΔH (H) (J/g) | ΔH (T)) (J/g) | ΔH (H)/ H (T) |
|---|---|---|---|---|---|---|---|---|---|
| Colorless Transparent Toner 1 | 0.35 | 55 | 35 | 20 | 45000 | 12 | 55 | 70 | 0.79 |
| Colorless Transparent Toner 2 | 0.32 | 51 | 39 | 12 | 29000 | 17 | 39 | 60 | 0.65 |
| Colorless Transparent Toner 3 | 0.29 | 59 | 42 | 17 | 35000 | 11 | 62 | 105 | 0.59 |
| Colorless Transparent Toner 4 | 0.38 | 63 | 34 | 29 | 18000 | 6 | 67 | 54 | 1.24 |
| Colorless Transparent Toner 5 | 0.31 | 53 | 38 | 15 | 58000 | 14 | 46 | 160 | 0.29 |
| Colorless Transparent Toner 6 | 0.19 | 69 | 45 | 24 | 69000 | 18 | 39 | 120 | 0.33 |
| Colorless Transparent Toner 7 | 0.14 | 63 | 41 | 22 | 66000 | 17 | 55 | 67 | 0.82 |
| Colorless Transparent Toner 8 | 0.22 | 56 | 37 | 19 | 23000 | 8 | 69 | 100 | 0.69 |
| Colorless Transparent Toner 9 | 0.27 | 62 | 29 | 33 | 32000 | 12 | 39 | 220 | 0.18 |
| Colorless Transparent Toner 10 | 0.11 | 49 | 45 | 4 | 19000 | 6 | 46 | 70 | 0.66 |
| Colorless Transparent Toner 11 | 0.14 | 71 | 58 | 13 | 72000 | 10 | 38 | 200 | 0.19 |
| Colorless Transparent Toner 12 | 0.04 | 75 | 65 | 10 | 88000 | 21 | 71 | 87 | 0.82 |
| Colorless Transparent Toner 13 | 0.28 | 58 | 27 | 31 | 57000 | 14 | 52 | 42 | 1.24 |

Manufacturing of Carrier

Use 5,000 parts by weight of Mn ferrite particles (weight average particle diameter: 35 μm) as the core material.

Disperse 450 parts of toluene, 450 parts of silicone resin (SR 2400, manufactured by DOW CORNING TORAY CO., LTD.), 10 parts of amino silane (SH6020, manufactured by DOW CORNING TORAY CO., LTD.), and 10 parts of carbon black by a stirrer for 10 minutes to prepare coating liquid for the coating material.

Place the core material and the coating liquid in a coating device having a rotatable base plate disk and a stirring wing to apply the coating liquid to the material.

Bake the thus-obtained coated material at 250° C. in an electric furnace for two hours to obtain Carrier 1.

Manufacturing of Development Agent

Uniformly mix 7 parts by weight of toner (Colorless Transparent Toner 1 to 13, Color Toner 1 to 13) with 100 parts of Carrier 1 for three minutes by using a turbular mixer (manufactured by Willy A. Bachofen (WAB) AG) to obtain development agents of Examples and Comparative Examples.

Evaluation

Hot Offset Resistance

Form 5 cm square solid image on photocopy paper (TYPE 6000 <70W> (manufactured by Ricoh Co. Ltd.) by using two tandem type color image forming apparatuses (imagio Neo 450, manufactured by Ricoh Co., Ltd.).

Form the solid image at four places using the first image forming apparatus and the color toner obtained in each Example and Comparative Example.

In addition, superimpose the colorless transparent toner on the obtained solid images by using the second image forming apparatus to superimpose the colorless transparent toner on the color toner.

Fix the obtained superimposed solid images while changing the fixing temperature.

Operate the image forming apparatus in an environment in which the amount of the attachment of the toner is preliminarily adjusted to be from 1.35 mg/cm$^2$ to 1.45 mg/cm$^2$ when the solid image is formed by using each simple color toner of the cyan, the magenta, the yellow, the black, and the colorless transparent toner.

The highest temperature at which no hot offset occurs at any of all the four solid images is determined as the upper limit of the fixing temperature.

The evaluation criteria are as follows:

A: the upper limit of the fixing temperature is 190° C. or higher

B: the upper limit of the fixing temperature is from 180° C. to lower than 190° C.

C: the upper limit of the fixing temperature is from 170° C. to lower than 180° C.

D: the upper limit of the fixing temperature is lower than 170° C.

The evaluation results are shown in Table 4.

TABLE 4

| | | Evaluation | |
|---|---|---|---|
| | | Hot offset | Abrasion resistance |
| Example 1 | Toner Set 1 | B | B |
| Example 2 | Toner Set 2 | A | A |
| Example 3 | Toner Set 3 | B | A |
| Example 4 | Toner Set 4 | B | B |
| Example 5 | Toner Set 5 | A | A |
| Example 6 | Toner Set 6 | B | A |

TABLE 4-continued

| | | Evaluation | |
|---|---|---|---|
| | | Hot offset | Abrasion resistance |
| Example 7 | Toner Set 7 | B | B |
| Example 8 | Toner Set 8 | A | A |
| Example 9 | Toner Set 9 | B | B |
| Comparative Example 1 | Toner Set 10 | C | C |
| Comparative Example 2 | Toner Set 11 | B | C |
| Comparative Example 3 | Toner Set 12 | C | C |
| Comparative Example 4 | Toner Set 13 | D | C |

Abrasion Resistance

Evaluate the images on the abrasion resistance by using the same tandem type color image forming apparatus for use in evaluating the hot offset resistance.

Develop image samples on a transparent sheet (TYPE PPC-DX, manufactured by RICOH CO., LTD.) while setting the fixing belt at 160° C.

The image samples are solid images of 5 cm square for the four colors of cyan, magenta, yellow, and black followed by superimposing of the colorless transparent toner.

Operate the image forming apparatus in an environment in which the amount of the attachment of the toner is preliminarily adjusted to be from 1.35 mg/cm$^2$ to 1.45 mg/cm$^2$ when the solid image is formed by using each simple color toner of the cyan, the magenta, the yellow, the black, and the colorless transparent toner.

Abrade the solid images three times with #2000 paper file and check the change of the haze level between before and after the abrasion to evaluate the average variations of the four colors by the following evaluation criteria:

The evaluation criteria are as follows:

A: Increase of haze level less than 10%

B: Increase of haze level of from 10% to less than 30%

C: Increase of haze level of 30% or greater

The haze level is measured as an indication of the transparency of toner.

Normally, the transparency is high as this level decreases and the coloring is good on a transparent sheet.

If an image has little abrasion resistance, the haze level deteriorates and increases when the surface of the image is rubbed.

The toner evaluated as B or higher is practically usable.

The evaluation results of the abrasion resistance are shown in Table 4.

As seen in Table 4, since the toner of the present disclosure uses a colorless transparent toner containing a crystalline resin having a urethane bond and/or a urea bond, the toner has a good combination of the hot offset resistance and the abrasion resistance.

To the contrary, when the colorless transparent toner containing the non-crystalline resin or the crystalline resin having no urethane bond or urea bond is used, the toner does not have a good combination of the hot offset resistance and the abrasion resistance.

What is claimed is:

1. A colorless transparent toner comprising:

a binder resin that comprises a crystalline resin having a urethane bond and/or a urea bond;

wherein the colorless transparent toner has a ratio {C/(C+A)} of 0.15 or greater, where C represents an integration intensity of a spectrum deriving from a crystalline structure and A represents an integration intensity of a spectrum deriving from a non-crystalline structure in a diffraction spectrum obtained by an X-ray diffraction device; and wherein the colorless transparent toner satisfies the relations:

$$T1-T2 \leq 30^\circ \text{ C. and } T2 \geq 30^\circ \text{ C.},$$

where T1 represents a maximum endothermic peak temperature for a second time temperature rising and T2 represents a maximum exothermic peak temperature for a first time temperature descending as measured by a differential scanning calorimeter in a temperature range of from 0° C. to 100° C. at a temperature rising and descending speed of 10° C./min.

2. The colorless transparent toner according to claim 1, wherein the colorless transparent toner has a ratio {C/(C+A)} of 0.17 or greater.

3. The colorless transparent toner according to claim 1, wherein the toner has a molecular weight of 100,000 or greater in a ratio of 5% or higher and a weight average molecular weight of from 20,000 to 70,000 as measured by gel diffusion chromatography for a soluble portion in tetrahydrofuran.

4. The colorless transparent toner according to claim 1, wherein a ratio of ΔH(H)/ΔH(T) ranges from 0.2 to 1.25, where ΔH(T) represents an endothermic amount of the toner as measured by a differential scanning calorimeter and ΔH(H) represents an endothermic amount of an insoluble portion of the toner in a liquid mixture of ethyl acetate and tetrahydrofuran (THF) having a mixing ratio of 1:1 as measured by a differential scanning calorimeter.

5. The colorless transparent toner according to claim 1, wherein the crystalline resin comprises a crystalline polyester resin having a urethane bond and/or a urea bond.

6. The colorless transparent toner according to claim 1, further comprising an organic-modified inorganic laminar compound in which organic ions are at least partially substituted for ions present between layers of the organic-modified inorganic laminar compound.

7. The colorless transparent toner according to claim 1, wherein the crystalline resin is formed by elongation and/or cross-linking reaction between a polyester resin and di—or higher isocyanate compound.

8. A toner set comprising:

the colorless transparent toner of claim 1; and a color toner.

9. A development agent comprising:

the colorless transparent toner of claim 1; and a carrier.

10. The colorless transparent toner or claim 1, wherein the amount of crystalline resin in the binder resin is 50% or more.

11. The colorless transparent toner or claim 1, wherein the amount of crystalline resin in the binder resin is 80% or more.

12. The colorless transparent toner or claim 1, wherein the amount of crystalline resin in the binder resin is 95% or more.

* * * * *